US007169241B2

(12) United States Patent
Tamaki et al.

(10) Patent No.: US 7,169,241 B2
(45) Date of Patent: Jan. 30, 2007

(54) NI-BASED SUPERALLOY HAVING HIGH OXIDATION RESISTANCE AND GAS TURBINE PART

(75) Inventors: Hideki Tamaki, Hitachi (JP); Akira Yoshinari, Hitachinaka (JP); Akira Okayama, Hitachi (JP); Tsuyoshi Takano, Hitachi (JP); Hiroyuki Doi, Tokai (JP)

(73) Assignee: Hitachi, Ltd., Tokyo (JP)

( * ) Notice: Subject to any disclaimer, the term of this patent is extended or adjusted under 35 U.S.C. 154(b) by 201 days.

(21) Appl. No.: 10/804,065

(22) Filed: Mar. 19, 2004

(65) Prior Publication Data

US 2004/0221925 A1 Nov. 11, 2004

(30) Foreign Application Priority Data

May 9, 2003 (JP) ..... 2003-130966

(51) Int. Cl.
*C22C 19/05* (2006.01)

(52) U.S. Cl. ..... 148/428; 420/443; 420/444; 420/448

(58) Field of Classification Search ..... None
See application file for complete search history.

(56) References Cited

U.S. PATENT DOCUMENTS

| | | | | |
|---|---|---|---|---|
| 3,526,499 | A * | 9/1970 | Collins et al. | 420/448 |
| 4,169,742 | A * | 10/1979 | Wukusick et al. | 148/404 |
| 4,719,080 | A * | 1/1988 | Duhl et al. | 420/443 |
| 5,759,301 | A * | 6/1998 | Konter et al. | 148/404 |
| 6,051,083 | A * | 4/2000 | Tamaki et al. | 148/410 |
| 6,355,117 | B1 * | 3/2002 | DeLuca et al. | 148/404 |
| 6,632,299 | B1 * | 10/2003 | Harris | 148/428 |
| 6,638,639 | B1 * | 10/2003 | Burke et al. | 428/583 |
| 2002/0164263 | A1 * | 11/2002 | Harris et al. | 420/448 |
| 2003/0091459 | A1 * | 5/2003 | Harris et al. | 420/444 |
| 2004/0261921 | A1 * | 12/2004 | Nazmy | 148/675 |
| 2005/0016641 | A1 * | 1/2005 | DeLuca et al. | 148/556 |
| 2005/0139295 | A1 * | 6/2005 | O'Hara et al. | 148/428 |

FOREIGN PATENT DOCUMENTS

| | | |
|---|---|---|
| JP | 6-57359 | 3/1994 |
| JP | 6-184685 | 7/1994 |
| JP | 2905473 | 3/1999 |

* cited by examiner

*Primary Examiner*—John P. Sheehan
(74) *Attorney, Agent, or Firm*—Mattingly, Stanger, Malur & Brundidge, P.C.

(57) ABSTRACT

A Ni-based alloy hardened with the γ' phase, which is able to exhibit not only superior strength at high temperatures, but also excellent hot corrosion resistance and oxidation resistance at high temperatures in spite of containing no Re or reducing the amount of Re. The Ni-based superalloy contains, by weight, C: 0.01 to 0.5%, B: 0.01 to 0.04%, Hf: 0.1 to 2.5%, Co: 0.8 to 15%, Ta: more than 0% but less than 8.5%, Cr: 1.5 to 16%, Mo: more than 0% but less than 1.0%, W: 5 to 14%, Ti: 0.1 to 4.75%, Al: 2.5 to 7%, Nb: more than 0% but less than 4%, V: 0 to less than 1.0%, Zr: 0 to less than 0.1%, Re: 0 to less than 9%, at least one of platinum group elements: 0 to less than 0.5% in total, at least one of rare earth elements: 0 to less than 0.1% in total, and the rest being Ni except for unavoidable impurities.

8 Claims, 16 Drawing Sheets

NI-BASED SUPERALLOY HAVING HIGH OXIDATION RESISTANCE AND GAS TURBINE PART

BACKGROUND OF THE INVENTION

1. Field of the Invention

The present invention relates to a Ni-based superalloy having excellent oxidation resistance at high temperatures, and a gas turbine part made of the Ni-based superalloy. The Ni-based superalloy of the present invention is suitable for use in rotor blades and stator vanes of gas turbines.

2. Description of the Related Art

The combustion gas temperature in gas turbines tends to increase year by year for the purpose of increasing thermal efficiency. Correspondingly, gas turbine parts have been required to have more superior strength, hot corrosion resistance, and oxidation resistance at high temperatures.

Hitherto, Ni-based superalloys hardened with γ'-precipitation have been used in rotor blades and stator vanes of gas turbines. Also, improvements of material properties of alloys have been made by employing various chemical compositions, a variety of content ranges, and/or various methods for producing castings (see, for example, JP,A 6-57359 (claims), JP,A 6-184685 (claims), and Japanese Patent No. 2905473 (claims)).

SUMMARY OF THE INVENTION

Ni-based superalloys developed for use in gas turbines for airplane engines generally contain a large amount of expensive Re with importance put on strength at high temperatures, and contain a small amount of Cr that is effective in improving hot corrosion resistance. On the other hand, Ni-based superalloys developed for use in industrial gas turbines contain large amounts of Cr and Ti with importance put on hot corrosion resistance, and contain a small amount of expensive Re.

In the industrial gas turbines, however, it has also been required to employ alloys having superior strength at high temperatures, as well as excellent hot corrosion resistance and oxidation resistance at high temperatures, from the viewpoint of raising the combustion gas temperature and increasing the thermal efficiency.

Accordingly, it is an object of the present invention to provide a Ni-based superalloy which exhibits two different natures of characteristics having been regarded as contradictory to each other in the past, i.e., superior creep strength at high temperatures and excellent hot corrosion resistance and oxidation resistance at high temperatures, in spite of containing no expensive Re or containing a small amount of Re.

The present invention has been accomplished by conducting studies on optimum balance among respective contents of elements which are classified into three groups, i.e., elements Cr, Mo, W and Re for strengthening primarily the γ phase as a matrix of the Ni-based superalloy, elements Ta, Ti and Nb for strengthening primarily the γ' phase as a precipitation hardening phase, and elements C, B, Hf and Zr for strengthening primarily the grain boundary, and by conducting closer studies on balance between the γ-phase strengthening elements and the γ'-phase strengthening elements in respective total contents.

The present invention resides in a Ni-based superalloy having high oxidation resistance, the superalloy being hardened by dispersing γ' phases in a γ-phase matrix, wherein the superalloy contains, by weight, C: 0.01 to 0.5%, B: 0.01 to 0.04%, Hf: 0.1 to 2.5%, Co: 0.8 to 15%, Ta: less than 8.5%, Cr: 1.5 to 16%, Mo: less than 1.0%, W: 5 to 14%, Ti: 0.1 to 4.75%, Al: 2.5 to 7%, Nb: less than 4%, V: 0 to less than 1.0%, Zr: 0 to less than 0.1%, Re: 0 to less than 9%, at least one of platinum group elements: 0 to less than 0.5% in total, and at least one of rare earth elements: 0 to less than 0.1% in total. The other ingredient is Ni except for unavoidable impurities, such as P and S, which are mixed in the superalloy during the production stage.

In the present invention, the platinum group elements mean Ru, Rh, Pd, Ir, and Pt. Among these elements, Ru is most preferable. Also, the rare earth elements mean Sc, Y and lanthanoid, i.e., La, Ce, Pr, Nd, Pm, Sm, Eu, Gd, Tb, Dy, Ho, Er, Tm, Yb and Lu. Among these elements, Y is most preferable.

In the Ni-based superalloy of the present invention, when most importance is put on strength at high temperatures, the superalloy preferably contains, by weight, C: 0.05 to 0.2%, B: 0.01 to 0.03%, Hf: 1.1 to 2.5%, Co: 9.7 to 15%, Ta: 0.1 to 4.5%, Cr: 1.5 to 9%, Mo: 0.01 to 0.9%, W: 5 to 14%, Ti: 0.1 to 4.75%, Al: 4 to 7%, Nb: 0.1 to less than 4%, and Re: 0.01 to less than 9%. V and Zr are intentionally not added and their contents are each held not more than 0.005%. The rest is Ni along with the unavoidable impurities.

When importance is put on oxidation resistance at high temperatures of not lower than 1000° C. in addition to strength at high temperatures, the superalloy preferably contains, by weight, C: 0.05 to 0.2%, B: 0.01 to 0.03%, Hf: 1.1 to 2.5%, Co: 9.7 to 15%, Ta: 0.1 to 4.5%, Cr: 1.5 to 9%, Mo: 0.01 to 0.9%, W: 5 to 14%, Ti: 0.1 to 0.45%, Al: 4 to 7%, Nb: 0.1 to less than 4%, Re: 0.01 to less than 9%, and at least one of rare earth elements: 0 to less than 0.1% in total. V and Zr are intentionally not added and their contents are each held not more than 0.005%. The rest is Ni along with the unavoidable impurities.

When importance is put on hot corrosion resistance as well while greater importance is put on strength at high temperatures, the superalloy preferably contains, by weight, C: 0.05 to 0.2%, B: 0.01 to 0.03%, Hf: 1.1 to 2.5%, Co: 0.8 to 4.75%, Ta: 0.1 to 4.5%, Cr: 1.5 to 9%, Mo: 0.01 to 0.9%, W: 5 to 14%, Ti: 0.1 to 4.75%, Al: 4 to 7%, Nb: 0.1 to less than 4%, Re: 0.01 to less than 9%, at least one of rare earth elements: 0 to less than 0.1% in total, and any of V and Zr: not more than 0.005%. The rest is Ni along with the unavoidable impurities.

When importance is put on oxidation resistance at high temperatures of not lower than 1000° C. in addition to strength at high temperatures and hot corrosion resistance, the superalloy preferably contains, by weight, C: 0.05 to 0.2%, B: 0.01 to 0.03%, Hf: 1.1 to 2.5%, Co: 0.8 to 4.75%, Ta: 0.1 to 4.5%, Cr: 1.5 to 9%, Mo: 0.01 to 0.9%, W: 5 to 14%, Ti: 0.1 to 0.45%, Al: 4 to 7%, Nb: 0.1 to less than 4%, Re: 0.01 to less than 9%, and at least one of rare earth elements: 0 to less than 0.1% in total. V and Zr are intentionally not added and their contents are each held not more than 0.005%. The rest is Ni along with the unavoidable impurities.

In practice, the Ni-based superalloy of the present invention is used after performing only aging heat treatment subsequent to casting without solution heat treatment, or after performing solution heat treatment subsequent to casting and then aging heat treatment.

The solution heat treatment is heat treatment for making the γ' phases dispersed in the solid-solution state in the γ-phase as the matrix. In the present invention, the solution heat treatment may be replaced with partial solution heat treatment in which only a part of the γ' phases is brought into the solid-solution state in the matrix.

Also, the aging heat treatment is heat treatment for precipitating the γ' phases. In the present invention, the aging heat treatment may be performed plural times.

The solution heat treatment performed at high temperatures is effective in increasing the strength at high temperatures, while it imposes negative factors upon large-sized castings used in industry-oriented gas turbines because of causing re-crystallization, reducing the strength of grain boundary with moving of the grain boundary, and hence pushing up the cost. Accordingly, when superior strength at high temperatures is required without performing the solution heat treatment, the superalloy preferably contains, by weight, C: 0.01 to 0.5%, B: 0.01 to 0.03%, Hf: 1.1 to 2.5%, Co: 9.7 to 15%, Ta: less than 8.5%, Cr: 1.5 to 16%, Mo: less than 1.0%, W: 5 to 14%, Ti: 0.1 to 4.75%, Al: 4 to 7%, Nb: less than 4%, Re: 0.01 to less than 9%, at least one of platinum group elements: 0 to less than 0.5% in total, and at least one of rare earth elements: 0 to less than 0.1% in total. V and Zr are intentionally not added, and the rest is Ni along with the unavoidable impurities. In addition, a value obtained from a formula of (0.004×W content (weight %)+0.004×2×Mo content (weight %)+0.004×Re content (weight %))/(0.003×3×Ti content (weight %)+0.006×Ta content (weight %)+0.006×2×Nb content (weight %)) is preferably in the range of 1.0 to 2.5 and more preferably in the range of 1.5 to 2.0.

When importance is put on hot corrosion resistance rather than strength at high temperatures, the superalloy preferably contains, by weight, C: 0.05 to 0.2%, B: 0.01 to 0.03%, Hf: 0.1 to 2.5%, Co: 0.8 to 15%, Ta: 0.1 to 4.5%, Cr: 9 to 16%, Mo: 0.01 to 0.3%, W: 5 to 14%, Ti: 0.1 to 4.75%, Al: 2.5 to 7%, Nb: 0.1 to less than 4%, Re: 0 to less than 9%, and at least one of rare earth elements: 0 to less than 0.1% in total. V, Zr and platinum group elements are not contained. The rest is Ni along with the unavoidable impurities.

When importance is put on hot corrosion resistance rather than strength at high temperatures and importance is also put on ductility, the superalloy preferably contains, by weight, C: 0.05 to 0.2%, B: 0.01 to 0.03%, Hf: 1.1 to 2.5%, Co: 0.8 to 15%, Ta: 0.1 to 4.5%, Cr: 9 to 16%, Mo: 0.01 to 0.3%, W: 5 to 14%, Ti: 0.1 to 4.75%, Al: 2.5 to 4.5%, Nb: 0.1 to less than 4%, Re: 0 to less than 9%, and at least one of rare earth elements: 0 to less than 0.1% in total. V, Zr and platinum group elements are not contained. The rest is Ni along with the unavoidable impurities.

When importance is put on hot corrosion resistance and a cost reduction is intended, the superalloy preferably contains, by weight, C: 0.05 to 0.2%, B: 0.01 to 0.03%, Hf: 0.1 to 2.5%, Co: 0.8 to 15%, Ta: less than 0.5%, Cr: 9 to 16%, Mo: 0.01 to 0.3%, W: 5 to 14%, Ti: 2 to 4.75%, Al: 2.5 to less than 4%, Nb: 0.75 to less than 4%, and at least one of rare earth elements: 0 to less than 0.1% in total. V and Zr are intentionally not added. The rest is Ni along with the unavoidable impurities.

When much importance is put on hot corrosion resistance, the superalloy preferably contains, by weight, C: 0.05 to 0.2%, B: 0.01 to 0.03%, Hf: 0.1 to 2.5%, Co: 0.8 to 15%, Ta: less than 0.5%, Cr: more than 13% but not more than 16%, Mo: 0.01 to 0.3%, W: 5 to 14%, Ti: 2 to 4.75%, Al: 2.5 to less than 4%, and Nb: 2 to less than 4%. V and Zr are intentionally not added. The rest is Ni along with the unavoidable impurities.

When importance is put on hot corrosion resistance and an alloy balanced between micro-structural stability and oxidation resistance at high temperatures is intended, the superalloy preferably contains, by weight, C: 0.05 to 0.2%, B: 0.01 to 0.03%, Hf: 0.1 to 2.5%, Co: 0.8 to 15%, Ta: 0.1 to 4.5%, Cr: 9 to 16%, Mo: 0.01 to 0.3%, W: 5 to 14%, Ti: 2 to 4.75%, Al: 2.5 to less than 4.5%, Nb: 0.1 to less than 4%, Re: 0 to less than 9%, and at least one of rare earth elements: 0 to less than 0.1% in total. V and Zr are intentionally not added. The rest is Ni along with the unavoidable impurities. In addition, a value obtained from a formula of (3.8×Ti content (weight %)+2×Nb content (weight %)+Ta content (weight %))/(2×Mo content (weight %)+W content (weight %)+Re content (weight %)) is in the range of 1.6 to 2.8, and a value obtained from a formula of (3.8×Ti content (weight %)+3.5×Cr content (weight %))/(6.8×Al content (weight %)) is in the range of 1.8 to 3.1.

Further, according to the present invention, a casting made of the Ni-based superalloy set forth above is provided. In particular, a unidirectionally solidified casting is provided. The Ni-based superalloy casting according to the present invention is suitable as a high-temperature part for gas turbines, and it is suitably used as a rotor blade or a stator vane for industrial gas turbines.

The effects and proper content ranges of the individual elements will be described below.

C forms MC-type carbides with Hf, Ta, Nb, Ti, etc. and forms $M_{23}C_6$- and $M_6C$-type carbides with Cr, W, Mo, etc., thereby impeding movement of the grain boundary at high temperatures, thereby impeding movement of the grain boundary at high temperatures and strengthening the grain boundary. In order to obtain that effect, the supperalloy is required to contain C of not less than at least 0.01% at minimum by weight and preferably not less than 0.05%. If the C content is increased, the elements effective in strengthening of the γ phase and the γ' phase in the solid-solution state are captured by carbides and the alloy strength at high temperatures reduces. Accordingly, the upper limit of the C content must be restricted to 0.5 percent by weight. When importance is put on the strength at high temperatures, it is desired that the upper limit of the C content be set to 0.2 percent by weight.

B has the effect of filling a non-aligned portion of the grain boundary and increasing the bonding force of the grain boundary. The superalloy is required to contain at least 0.01 percent by weight. However, because B noticeably lowers the melting point of the Ni-based superalloy, the B content must be restricted to 0.04 percent by weight at maximum. From the viewpoint of stabilizing the strength at high temperatures, it is desired that the upper limit of the B content be set to 0.03 percent by weight.

Hf segregates at the grain boundary and develops the effect of increasing ductility of the grain boundary. However, if the alloy strength is increased, the strength of the grain boundary is relatively reduced and the alloy ductility is noticeably reduced. The presence of Hf is effective in preventing such a phenomenon. Hence, the superalloy is required to contain Hf of at least 0.1 percent by weight and, in particularly, preferably not less than 1.1 percent by weight. Excessive addition of Hf, however, lowers the alloy melting point as with B. For that reason, the upper limit of the Hf content must be set to 2.5 percent by weight.

Co has the effect of lowering the solution temperature of the γ' phase and enabling the solution heat treatment to be more easily performed. Particularly, when used in partial solution, Co has the effect of increasing the volume fraction of solutioned area even at low heat-treatment temperatures. Also, even when used in the production process not including the solution heat treatment, addition of Co has the effect of lowering the precipitation temperature of the γ' phase and increasing an area in which the γ' phase having an excellent shape is precipitated. Those effects also contribute to increasing the strength at high temperatures. In order to develop those effects, the superalloy is required to contain Co of not less than at least 0.8 percent by weight. In the case of producing the superalloy with much importance put on the strength at high temperatures, the Co content is preferably not less than 9.7 percent by weight. Excessive addition of Co, however, makes the γ' phase instable and rather leads to a reduction of the strength. For that reason, the Co content must be held not more than 15 percent by weight at maximum. Additionally, because of Co reducing hot corrosion resistance, the Co content is in the range of not more than 4.75 percent by weight when hot corrosion resistance is required and the Cr content is less than 9 percent by weight.

Ta is an element very effective in strengthening of the γ' phase in the solid-solution state. In order to obtain superior strength at high temperatures without performing the solution heat treatment, an absolute value of mismatch in the lattice constants between the γ' phase and the γ phase must be kept small, and the Ta content must be more than 0% but less than 8.5 percent by weight. From the standpoint of minimizing the mismatch in the lattice constants, the Ta content is preferably not more than 4.5 percent by weight. Because of Ta being an expensive element, it is desired when importance is put on the cost that the Ta content be less than 0.5 percent by weight while the Nb content be increased. Replacement of a part of Ta with Nb rather improves hot corrosion resistance.

In contrast with Ta, W is effective in strengthening of primarily the γ phase in the solid-solution state. To keep small an absolute value of mismatch in the lattice constants between the γ' phase and the γ phase, the superalloy is required to contain W of not less than at least 5 percent by weight. Excessive addition of W, however, deteriorates the phase stability of the alloy and leads to precipitation of a deleterious phase, e.g., a TCP phase, thereby noticeably reducing the hot corrosion resistance. For that reason, the W content must be restricted to 14 percent by weight at maximum.

Mo is an element belonging to the same group as W and has substantially the same effect as W. In order to obtain superior strength at high temperatures, it is desired that the superalloy contain Mo of not less than 0.01 percent by weight. However, the inventors have confirmed that addition of Mo deteriorates hot corrosion resistance in combustion environment to far larger extent than addition of W. Therefore, the Mo content in the superalloy of the present invention is selected to be less than 1.0 percent by weight at maximum and preferably not more than 0.9 percent by weight. When much importance is put on hot corrosion resistance, the Mo content is preferably not more than 0.3 percent by weight.

As with W and Mo, Re is effective in strengthening of primarily the γ phase in the solid-solution state. Also, Re deteriorates hot corrosion resistance in combustion environment, but its influence is smaller than Mo and W. Re is therefore an element very effective in realizing hot corrosion resistance and strength at high temperatures in balance. However, Re is distributed into the γ' phase at a much lower rate and hence tends to affect the phase stability. For that reason, the Re content must be less than 9 percent by weight at maximum. Because of Re being a very expensive element, it is desired that Re be added at the necessary least content when the superalloy is used in large-sized industrial gas turbines. When importance is put on the cost, Re can be excluded from the added elements.

Cr forms a protective layer of $Cr_2O_3$, and it is an essential element for maintaining hot corrosion resistance of the Ni-based superalloy. Accordingly, the superalloy is required to contain Cr of at least 1.5 percent by weight. When importance is put on hot corrosion resistance, the Cr content is preferably not less than 9 percent by weight, and when much importance is put on hot corrosion resistance, the Cr content is preferably not less than 13 percent by weight. Excessive addition of Cr, however, deteriorates the phase stability of the alloy and leads to precipitation of a deleterious phase, e.g., a TCP phase, as with W. For that reason, the upper limit of the Cr content must be restricted to 16 percent by weight. When it is required to increase the W and Re contents for the purpose of enhancing the strength at high temperatures, the Cr content is preferably selected to be not more than 9 percent by weight.

Al is an essential element for forming $Ni_3Al$ as the γ' phase, and the superalloy is required to contain Al of not less than at least 2.5 percent by weight. When increasing a volume fraction of the γ' phase with importance put on strength at high temperatures, the Al content is preferably not less than 4 percent by weight. Further, Al forms a protective layer of $Al_2O_3$, thereby improving oxidation resistance and hot corrosion resistance. Excessive addition of Al, however, deteriorates the strengthening of the γ' phase in the solid-solution state and rather reduces the strength at high temperatures. For that reason, the Al content must be held not more than 7 percent by weight at maximum. When the Cr content is increased with importance put on hot corrosion resistance, the Al content is selected to be preferably in the range of 2.5 to 4.5 percent by weight and more preferably in the range of 2.5 to less than 4 percent by weight.

Ti has the effect of preventing formation of composite oxides of Cr and Al, thereby improving corrosion resistance of the superalloy. Accordingly, the superalloy is required to contain Ti of at least 0.1 percent by weight. When more importance is put on hot corrosion resistance, the Ti content is preferably not less than 2 percent by weight. Excessive addition of Ti, however, impedes stability of the γ' phase and deteriorates oxidation resistance at high temperatures. For that reason, the Ti content must be held at 4.75 percent by weight at maximum. If the Ti content is increased, this requires the content of the other γ'-phase strengthening element, i.e., Ta, to be reduced correspondingly, thus resulting in a reduction of the alloy strength. Therefore, when importance is put on both strength at high temperatures and oxidation resistance at high temperature of not lower than 1000° C., the Ti content is preferably selected to be not more than 0.45 percent by weight.

Nb has, though not so effective as Ti, the effect of preventing formation of composite oxides of Cr and Al, thereby improving hot corrosion resistance of the superalloy. Also, Nb has the effect of strengthening the γ' phase in the solid-solution state. This effect of Nb is smaller than that of Ta, but greater than that of Ti. Accordingly, Nb is an element effective in improving the hot corrosion resistance without reducing the strength at high temperatures. The minimum content of Nb may be an appreciable value. In order to effectively develop the above-mentioned effects, however, the Nb content is preferably not more than at least 0.1 percent by weight. When importance is put on both the hot corrosion resistance and the cost and the Ta content is not more than 0.5 percent by weight, the Nb content is selected to be preferably not less than 0.75 percent by weight and more preferably not less than 2 percent by weight. On the other hand, in order to maintain the phase stability of the γ' phase, the upper limit of the Nb content must be restricted to less than 4 percent by weight.

Zr has the similar effect to that of Hf. However, because addition of Zr significantly lowers the melting point of the Ni-based superalloy, the Zr content must be held less than 0.1 percent by weight even when added. On the other hand, it has been confirmed that Zr added in such a content range rather deteriorates ductility of the grain boundary. Accordingly, it is most desired in the superalloy of the present invention that Zr be intentionally not added and the Zr content be held as low as possible at 0.005 percent by weight or below.

Addition of V lowers a limitation in solid solution of Ta and Nb and hence leads to a reduction of the strength at high temperatures. Also, addition of V significantly deteriorates hot corrosion resistance. For those reasons, when added, the V content is held less than 1.0 percent by weight and, whenever possible, not more than 0.005 percent by weight. If possible, it is desired that V be not added.

The rare earth elements increase adhesion of a protective layer of $Al_2O_3$ and greatly improves oxidation resistance. Addition of the rare earth elements, however, significantly lowers the melting point of the Ni-based superalloy. For that reason, the content of the rare earth elements is preferably selected to be in the range of 0 to less than 0.1 percent by weight. The rare earth elements mean group-3A elements of the Periodic Table, which include Y, Sc, lanthanoid such as La and Ce, and actinoid such as Ac.

The platinum group elements have the action of widening a limitation in solid solution of the elements which are contained in the superalloy and are effective in enhancing the strength at high temperatures, such as W or Re. Because of being very expensive, the content of the platinum group elements is selected to be less than 0.5 percent by weight. It is desired that, whenever possible, the content of the platinum group elements be held not more than 0.005 percent by weight. The platinum group elements can be excluded from the added elements.

The formula of (0.004×W content (weight %)+0.004×2×Mo content (weight %)+0.004×Re content (weight %))/(0.003×3×Ti content (weight %)+0.006×Ta content (weight %)+0.006×2×Nb content (weight %)) (numerical value obtained from this formula will be referred to as a parameter 1 hereinafter) gives an index ratio representing how much the lattice constants of the γ phase and the γ' phase are increased respectively by the elements (such as W, Mo and Re) for strengthening primarily the γ phase and the elements (such as Ti, Ta and Nb) for strengthening primarily the γ' phase. A coefficient prefixed to each element represents how much the element increases the lattice constant of the γ- or γ' phase per 1 atom % (unit:$10^{-1}$ nm/at %). Further, because the coefficients are set on the premise that the mass numbers of Ta, W and Re are regarded as substantially equal to each other, the Nb, Mo and Ti contents are each multiplied by an additional coefficient corresponding to the mass number ratio of W to Nb, Mo or Ti. The mismatch in the lattice constants between the γ phase and the γ' phase can be estimated based on the parameter 1, and the range where the mismatch in the lattice constants can be kept satisfactory at high temperatures corresponds to the range of the parameter 1 from 1.0 to 2.5. If the mismatch in the lattice constants is smaller than 1.0, the lattice constant of the γ' phase would be too large, and if it is larger than 2.5, the lattice constant of the γ phase would be too large. In either case, the mismatch in the lattice constants cannot be kept satisfactory. In the range where the mismatch in the lattice constants is satisfactory, the γ' phase is stable and, even in the as-cast condition, the γ'-phase holds the cubic shape. Accordingly, the superalloy exhibits superior strength at high temperatures without the solution heat treatment. Even in the case of using the superalloy in the partial solid-solution state, it is also important to control the parameter 1 because the shape of the γ' phase in the as-cast condition causes influences. Industrial gas turbines have larger sizes than gas turbines for airplane engines. In the industrial gas turbines, therefore, excessive residual stresses are generated during the casting, and recrystallization tends to occur in the subsequent solution heat treatment. Also, the strength of the grain boundary in a unidirectionally solidified material reduces with movement of the grain boundary to a larger extent as the temperature of the solution heat treatment rises and the treatment time is prolonged. For that reason, an alloy used in high-temperature parts of the industrial gas turbines is preferably one that is able to exhibit superior strength at high temperatures without the solution heat treatment or with the partial solid-solution heat treatment in which the temperature of the solution heat treatment is set as low as possible and the treatment time is set as short as possible. Accordingly, the Ni-based superalloy with the parameter 1 being in the range of 1.5 to 2.5 is suitable for use as the high-temperature parts of the industrial gas turbines. When importance is put on particularly the strength at high temperatures, the parameter 1 is preferably set in the range of 1.0 to 2.0.

The formula of (3.8×Ti content (weight %)+2×Nb content (weight %)+Ta content (weight %))/(2×Mo content (weight %)+W content (weight %)+Re content (weight %)) (numerical value obtained from this formula will be referred to as a parameter 2 hereinafter) represents an atom % ratio of the elements (such as Ti, Nb and Ta) for strengthening primarily the γ' phase and the elements (such as Mo, W and Re) for strengthening primarily the γ phase. A small value of the parameter 2 indicates that the proportions of Mo and W adversely affecting hot corrosion resistance are relatively large, and hot corrosion resistance tends to deteriorate. In the case of the parameter 2 having a large value, i.e., in the case of Ti, Nb and Ta being added in larger amount, because these elements serve as η-phase forming elements, the η phase becomes more stable than the γ' phase and the alloy strength tends to lower. To obtain excellent hot corrosion resistance, therefore, the parameter 2 is required to be not less than 1.6. On the other hand, to obtain superior strength at high temperatures while keeping the γ' phase stable, the parameter 2 is required to be not more than 2.8.

The formula of (3.8×Ti content (weight %)+3.5×Cr content (weight %))/(6.8×Al content (weight %)) (numerical value obtained from this formula will be referred to as a parameter 3 hereinafter) represents an influence upon formation of an oxide layer effective for enhancement of hot corrosion resistance. The oxide layer is preferably formed as a multilayer made of $Cr_2O_3$, $TiO_2$ and $Al_2O_3$ in this order from an outermost layer, while a care should be paid so as to avoid formation of a composite oxide layer of those three elements. If the parameter 3 exceeds below 1.8, a composite oxide layer made of primarily Al and having lower protective effect would tend to form with a reduction of the ratio of Cr and Ti to Al, thus resulting in deterioration of hot corrosion resistance. On the other hand, if the parameter 3 exceeds above 3.1, a stable protective layer of $Al_2O_3$ would become hard to form with a reduction of the ratio of Al to Cr and Ti, thus similarly resulting in deterioration of hot corrosion resistance. For those reasons, the parameter 3 is preferably set in the range of 1.8 to 3.1.

DESCRIPTION OF THE PREFERRED EMBODIMENTS

Figure 1:
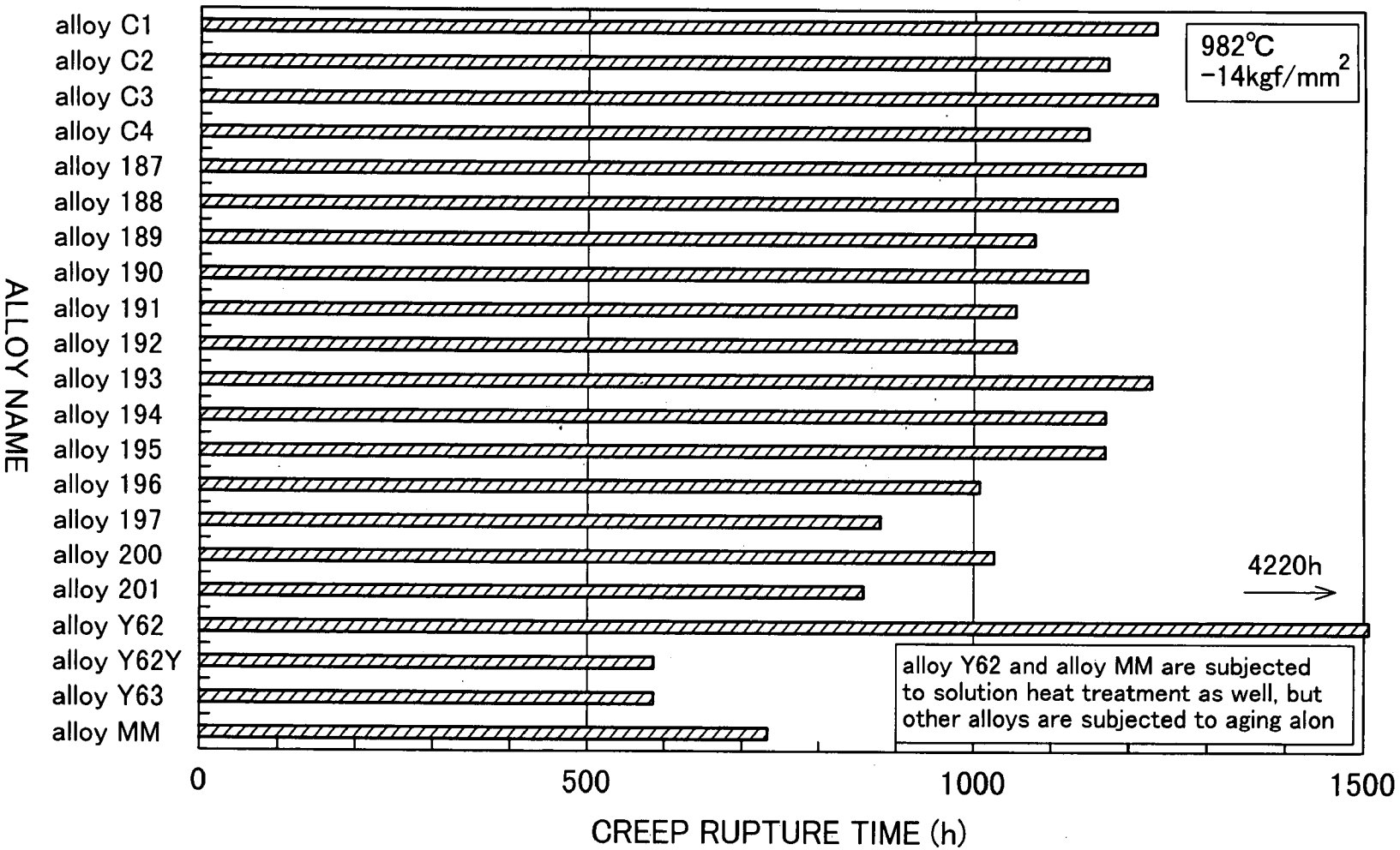
FIG. 1 is a graph showing the result of creep rupture tests made on an alloy group not subjected to the solution heat treatment.

Table 1, given below, lists chemical compositions and heat treatment conditions of alloys according to the present invention and comparative alloys employed in experiments which were conducted during the process for accomplishing the present invention. The alloys were classified into two groups, i.e., one in which the alloys were subjected to the solution heat treatment and then the aging heat treatment, and the other in which the alloys were subjected to the aging heat treatment only with omission of the solution heat treatment. The alloys subjected to the solution heat treatment are of the type that importance is put on hot corrosion resistance rather than strength at high temperatures, and the alloys not subjected to the solution heat treatment are of the type that importance is put on strength at high temperatures. Designing the alloy so as to have superior strength at high temperatures without the solution heat treatment is advantageous in preventing recrystallization during the solution heat treatment and cutting the cost required for the solution heat treatment.

The alloys listed in Table 1 were cast with a mold-drawing unidirectional solidifying process by using master ingots having respective compositions adjusted in advance. After the casting, the alloys were subjected to the heat treatments under the conditions shown in Table 1. Then, specimens for evaluation tests were sampled from the alloys by mechanical machining. The specimens for evaluation tests were each in the form of a unidirectionally solidified slab having sizes of 100 mm×15 mm×230 mm. The creep rupture time shown in Table 2 was evaluated under conditions of 850° C.-40 kgf/mm$^2$ or 982° C.-14 kgf/mm$^2$. The hot corrosion resistance was evaluated based on a weight change resulting from carrying out a burner rig test at 900° C. and repeating it 7 hours×5 cycles. Light oil containing 0.04 mass % sulfur was employed as fuel for the burner rig test, and for the purpose of accelerating hot corrosion, a solution of 1 mass % NaCl was sprayed into combustion gas at a rate of 30 cc/min. Furthermore, the oxidation resistance was evaluated based on a weight change resulting from heating the specimen in the atmosphere at a rate of 1100° C./20 h and repeating the heating 15 cycles.

TABLE 1

| | Chemical composition (wt %) | | | | | | | | | | | | | | | |
|---|---|---|---|---|---|---|---|---|---|---|---|---|---|---|---|---|
| alloy | Cr | Al | Ti | W | Mo | Ta | Nb | Re | Co | Hf | Zr | C | B | Y | Ru | Ni |
| alloy C1 | 6.25 | 5.65 | 0.40 | 8.61 | 0.55 | 3.30 | 0.21 | 2.98 | 10.50 | 1.40 | 0 | 0.07 | 0.015 | 0.01 | — | Bal. |
| alloy C2 | 6.13 | 5.88 | 0.40 | 8.47 | 0.48 | 3.10 | 0.22 | 2.90 | 4.50 | 1.40 | 0 | 0.07 | 0.015 | 0.01 | — | Bal. |
| alloy C3 | 6.25 | 5.65 | 0.70 | 8.61 | 0.55 | 2.60 | 0.21 | 2.95 | 10.60 | 1.40 | 0 | 0.07 | 0.015 | 0.01 | — | Bal. |
| alloy C4 | 6.15 | 5.89 | 0.70 | 8.49 | 0.50 | 3.15 | 0.23 | 2.91 | 4.49 | 1.40 | 0 | 0.07 | 0.015 | 0.01 | — | Bal. |
| alloy 187 | 6.03 | 5.73 | 0.70 | 8.55 | 0.50 | 2.30 | 0.58 | 2.97 | 10.30 | 1.50 | 0 | 0.07 | 0.015 | 0.01 | — | Bal. |
| alloy 188 | 6.07 | 5.76 | 0.71 | 8.60 | 0.50 | 1.14 | 1.17 | 2.98 | 10.20 | 1.45 | 0 | 0.07 | 0.015 | 0.01 | — | Bal. |
| alloy 189 | 6.10 | 5.73 | 0.71 | 8.64 | 0.51 | 0.20 | 1.77 | 3.00 | 9.85 | 1.43 | 0 | 0.07 | 0.015 | 0.01 | — | Bal. |
| alloy 190 | 6.01 | 5.71 | 0.23 | 8.52 | 0.50 | 2.26 | 1.15 | 2.96 | 9.98 | 1.41 | 0 | 0.07 | 0.015 | 0.01 | — | Bal. |
| alloy 191 | 6.08 | 5.75 | 0.23 | 8.57 | 0.50 | 1.14 | 1.75 | 2.97 | 9.87 | 1.49 | 0 | 0.07 | 0.015 | 0.01 | — | Bal. |
| alloy 192 | 6.08 | 5.78 | 0.23 | 8.62 | 0.51 | 0.20 | 2.34 | 2.88 | 10.05 | 1.37 | 0 | 0.08 | 0.015 | 0.01 | — | Bal. |
| alloy 193 | 6.00 | 5.70 | 0.23 | 8.98 | 0.25 | 2.26 | 1.15 | 2.95 | 10.01 | 1.38 | 0 | 0.07 | 0.015 | 0.01 | — | Bal. |
| alloy 194 | 6.03 | 5.73 | 0.23 | 9.03 | 0.25 | 1.13 | 1.75 | 2.97 | 9.97 | 1.37 | 0 | 0.07 | 0.015 | 0.01 | — | Bal. |
| alloy 195 | 6.07 | 5.76 | 0.23 | 9.08 | 0.25 | 0.20 | 2.34 | 2.98 | 9.96 | 1.41 | 0 | 0.08 | 0.015 | 0.01 | — | Bal. |
| alloy 196 | 6.07 | 5.57 | 0.80 | 9.08 | 2.59 | 2.89 | 0.21 | 1.50 | 9.88 | 1.28 | 0 | 0.07 | 0.015 | 0.01 | — | Bal. |
| alloy 197 | 6.25 | 5.54 | 0.80 | 10.10 | 1.73 | 2.88 | 0.22 | 1.49 | 9.87 | 1.33 | 0 | 0.08 | 0.015 | 0.01 | — | Bal. |
| alloy 200 | 6.20 | 5.75 | 0.70 | 7.50 | 0.85 | 4.48 | 0.21 | 2.95 | 10.00 | 1.40 | 0 | 0.09 | 0.016 | 0.01 | — | Bal. |

TABLE 1-continued

| | | | | | | | | | | | | | | | | |
|---|---|---|---|---|---|---|---|---|---|---|---|---|---|---|---|---|
| alloy 201 | 6.20 | 5.60 | 1.20 | 7.70 | 0.85 | 4.30 | 0.24 | 2.95 | 10.00 | 1.40 | 0 | 0.05 | 0.020 | 0.01 | — | Bal. |
| alloy 298 | 6.05 | 5.71 | 0.70 | 8.56 | 0.50 | 2.25 | 0.50 | 2.95 | 10.00 | 0.11 | 0.005 | 0.10 | 0.010 | 0.01 | — | Bal. |
| alloy 299 | 6.05 | 5.77 | 0.68 | 8.54 | 0.50 | 2.27 | 0.56 | 2.99 | 10.05 | 0.12 | 0.012 | 0.10 | 0.010 | 0.01 | — | Bal. |
| alloy 300 | 6.08 | 5.75 | 0.68 | 8.55 | 0.50 | 2.28 | 0.56 | 2.98 | 10.05 | 0.12 | 0.016 | 0.10 | 0.010 | 0.01 | — | Bal. |
| alloy 301 | 6.03 | 5.71 | 0.69 | 8.51 | 0.47 | 2.25 | 0.50 | 2.95 | 10.06 | 0.11 | 0.060 | 0.10 | 0.010 | 0.01 | — | Bal. |
| alloy 302 | 6.05 | 5.65 | 0.70 | 8.38 | 0.48 | 2.21 | 0.48 | 2.95 | 10.01 | 0 | 0 | 0.10 | 0.010 | 0.01 | — | Bal. |
| alloy 303 | 6.07 | 5.68 | 0.70 | 8.58 | 0.42 | 2.23 | 0.54 | 2.95 | 10.05 | 0.50 | 0 | 0.10 | 0.010 | 0.01 | — | Bal. |
| alloy 304 | 6.10 | 5.45 | 0.70 | 8.33 | 0.49 | 2.21 | 0.49 | 2.95 | 10.03 | 1.02 | 0 | 0.10 | 0.010 | 0.01 | — | Bal. |
| alloy 305 | 6.08 | 5.41 | 0.68 | 8.34 | 0.47 | 2.26 | 0.58 | 2.96 | 10.04 | 1.41 | 0 | 0.10 | 0.010 | 0.01 | — | Bal. |
| alloy 306 | 6.03 | 5.33 | 0.75 | 8.31 | 0.52 | 2.24 | 0.62 | 2.99 | 10.00 | 0.11 | 0 | 0 | 0.010 | 0.01 | — | Bal. |
| alloy 307 | 6.07 | 5.40 | 0.71 | 8.55 | 0.50 | 2.29 | 0.60 | 2.99 | 10.05 | 0.12 | 0 | 0.04 | 0.010 | 0.01 | — | Bal. |
| alloy 308 | 6.10 | 5.77 | 0.73 | 8.58 | 0.51 | 2.28 | 0.60 | 2.97 | 10.05 | 0.12 | 0 | 0.10 | 0 | 0.01 | — | Bal. |
| alloy 309 | 6.05 | 5.73 | 0.73 | 8.56 | 0.50 | 2.26 | 0.58 | 2.97 | 10.06 | 0.11 | 0 | 0.10 | 0.007 | 0.01 | — | Bal. |
| alloy 310 | 6.03 | 5.75 | 0.70 | 8.58 | 0.50 | 2.27 | 0.59 | 2.96 | 10.05 | 0.11 | 0 | 0.10 | 0.030 | 0.01 | — | Bal. |
| alloy Y62 | 7.10 | 5.10 | 0.11 | 8.80 | 0.80 | 8.90 | 0.80 | 1.40 | 1.00 | 0.25 | 0 | 0.07 | 0.020 | 0 | — | Bal. |
| alloy Y62Y | 7.10 | 5.10 | 0.12 | 8.80 | 0.80 | 8.90 | 0.80 | 1.40 | 1.00 | 0.25 | 0 | 0.07 | 0.020 | 0 | — | Bal. |
| alloy Y63 | 7.10 | 5.10 | 0.12 | 8.80 | 0.80 | 8.90 | 0.80 | 1.40 | 1.00 | 0.25 | 0 | 0.07 | 0.020 | 0 | — | Bal. |
| alloy MM | 8.25 | 5.56 | 0.75 | 9.65 | 0.50 | 3.05 | 0 | 0 | 9.50 | 1.40 | 0.007 | 0.07 | 0.015 | 0 | — | Bal. |
| alloy 241 | 8.66 | 5.21 | 0.00 | 7.37 | 0.17 | 11.81 | 0.12 | 0.00 | 10.00 | 1.12 | 0 | 0.07 | 0.015 | 0.01 | — | Bal. |
| alloy 242 | 8.86 | 5.33 | 1.26 | 7.54 | 0.17 | 9.11 | 0.13 | 0.00 | 10.01 | 1.13 | 0 | 0.07 | 0.015 | 0.01 | — | Bal. |
| alloy 245 | 8.96 | 4.80 | 2.33 | 7.64 | 0.18 | 6.72 | 0.14 | 0.00 | 10.02 | 1.15 | 0 | 0.07 | 0.015 | 0.01 | — | Bal. |
| alloy 246 | 9.05 | 4.22 | 3.41 | 7.67 | 0.18 | 4.23 | 0.15 | 0.00 | 10.05 | 1.17 | 0 | 0.07 | 0.015 | 0.01 | — | Bal. |
| alloy 247 | 9.19 | 3.69 | 4.57 | 7.83 | 0.18 | 1.76 | 0.16 | 0.00 | 9.97 | 1.18 | 0 | 0.07 | 0.015 | 0.01 | — | Bal. |
| alloy 248 | 9.27 | 3.72 | 4.60 | 7.89 | 0.18 | 0.05 | 1.01 | 0.00 | 9.75 | 1.12 | 0 | 0.07 | 0.015 | 0.01 | — | Bal. |
| alloy 251 | 9.75 | 5.25 | 0.00 | 6.37 | 0.17 | 11.91 | 0.14 | 0.00 | 9.76 | 1.11 | 0 | 0.07 | 0.015 | 0.01 | — | Bal. |
| alloy 252 | 9.97 | 5.38 | 1.27 | 6.51 | 0.17 | 9.19 | 0.12 | 0.00 | 9.77 | 1.12 | 0 | 0.07 | 0.015 | 0.01 | — | Bal. |
| alloy 255 | 10.10 | 4.84 | 2.35 | 6.59 | 0.18 | 6.78 | 0.11 | 0.00 | 9.78 | 1.11 | 0 | 0.07 | 0.015 | 0.01 | — | Bal. |
| alloy 256 | 10.22 | 4.29 | 3.47 | 6.68 | 0.18 | 4.31 | 0.11 | 0.00 | 9.79 | 1.13 | 0 | 0.07 | 0.015 | 0.01 | — | Bal. |
| alloy 257 | 10.35 | 3.73 | 4.61 | 6.76 | 0.18 | 1.77 | 0.10 | 0.00 | 9.80 | 1.14 | 0 | 0.07 | 0.015 | 0.01 | — | Bal. |
| alloy 258 | 10.27 | 4.92 | 2.39 | 6.70 | 0.18 | 3.45 | 1.87 | 0.00 | 9.85 | 1.12 | 0 | 0.07 | 0.015 | 0.01 | — | Bal. |
| alloy 259 | 10.33 | 4.34 | 3.50 | 6.75 | 0.18 | 2.18 | 1.21 | 0.00 | 9.88 | 1.11 | 0 | 0.07 | 0.015 | 0.01 | — | Bal. |
| alloy 260 | 10.44 | 3.76 | 4.65 | 6.82 | 0.18 | 0.05 | 1.01 | 0.00 | 9.96 | 1.12 | 0 | 0.07 | 0.015 | 0.01 | — | Bal. |
| alloy 281 | 13.02 | 2.93 | 4.80 | 11.69 | 0.16 | 0.05 | 0.11 | 0.00 | 9.71 | 1.11 | 0 | 0.07 | 0.015 | 0.01 | 0.2 | Bal. |
| alloy 282 | 13.02 | 2.93 | 4.81 | 9.64 | 0.16 | 2.02 | 0.11 | 0.00 | 9.73 | 1.12 | 0 | 0.07 | 0.015 | 0.01 | — | Bal. |
| alloy 283 | 13.03 | 2.93 | 4.81 | 7.59 | 0.16 | 4.04 | 0.12 | 0.00 | 9.71 | 1.14 | 0 | 0.07 | 0.015 | 0.01 | — | Bal. |
| alloy 284 | 13.03 | 2.94 | 4.81 | 5.54 | 0.16 | 6.06 | 0.11 | 0.00 | 9.77 | 1.11 | 0 | 0.07 | 0.015 | 0.01 | — | Bal. |
| alloy 285 | 13.07 | 3.40 | 4.02 | 7.62 | 0.16 | 4.05 | 0.12 | 0.00 | 9.78 | 1.12 | 0 | 0.07 | 0.015 | 0.01 | — | Bal. |
| alloy 286 | 13.12 | 3.86 | 3.23 | 7.64 | 0.16 | 4.06 | 0.11 | 0.00 | 9.79 | 1.12 | 0 | 0.07 | 0.015 | 0.01 | — | Bal. |
| alloy 287 | 13.16 | 4.33 | 2.43 | 7.67 | 0.16 | 4.08 | 0.11 | 0.00 | 9.80 | 1.13 | 0 | 0.07 | 0.015 | 0.01 | — | Bal. |
| alloy 289 | 12.93 | 3.36 | 2.39 | 7.54 | 0.16 | 4.01 | 1.93 | 0.00 | 9.77 | 1.11 | 0 | 0.07 | 0.015 | 0.01 | — | Bal. |
| alloy 290 | 13.38 | 3.94 | 3.29 | 7.80 | 0.16 | 0.05 | 2.12 | 0.00 | 9.72 | 1.11 | 0 | 0.07 | 0.015 | 0.01 | — | Bal. |
| alloy 291 | 13.43 | 4.42 | 2.48 | 7.83 | 0.17 | 0.05 | 2.13 | 0.00 | 9.73 | 1.11 | 0 | 0.07 | 0.015 | 0.01 | — | Bal. |
| alloy R | 14.00 | 3.00 | 5.00 | 4.00 | 4.00 | 0.00 | 0 | 0 | 9.50 | 0 | 0.030 | 0.17 | 0.015 | 0 | — | Bal. |
| alloy G | 14.00 | 3.00 | 4.90 | 3.80 | 1.50 | 2.80 | 0 | 0 | 9.50 | 0 | 0 | 0.10 | 0.010 | 0 | — | Bal. |

| | | | | Heat treatment | |
|---|---|---|---|---|---|
| alloy | Parameter 1 | Parameter 2 | Parameter 3 | solution heat treatment | Aging |
| alloy C1 | 1.89 | 0.41 | 0.61 | — | 1080° C./4 h + 871° C./20 h |
| alloy C2 | 1.92 | 0.41 | 0.57 | | |
| alloy C3 | 1.95 | 0.45 | 0.64 | | |
| alloy C4 | 1.68 | 0.51 | 0.60 | | |
| alloy 187 | 1.75 | 0.49 | 0.61 | | |
| alloy 188 | 1.74 | 0.49 | 0.61 | | |
| alloy 189 | 1.66 | 0.51 | 0.62 | | |
| alloy 190 | 1.67 | 0.44 | 0.56 | | |
| alloy 191 | 1.65 | 0.44 | 0.57 | | |
| alloy 192 | 1.57 | 0.46 | 0.56 | | |
| alloy 193 | 1.66 | 0.44 | 0.56 | | |
| alloy 194 | 1.65 | 0.44 | 0.56 | | |
| alloy 195 | 1.58 | 0.46 | 0.56 | | |
| alloy 196 | 2.18 | 0.40 | 0.64 | — | 1080° C./4 h + 871° C./20 h |
| alloy 197 | 2.08 | 0.42 | 0.66 | | |
| alloy 200 | 1.30 | 0.62 | 0.62 | | |
| alloy 201 | 1.17 | 0.76 | 0.69 | | |
| alloy 298 | 1.83 | 0.47 | 0.61 | 1250° C./4 h | |
| alloy 299 | 1.79 | 0.48 | 0.61 | | |
| alloy 300 | 1.79 | 0.48 | 0.61 | | |
| alloy 301 | 1.82 | 0.47 | 0.61 | | |
| alloy 302 | 1.83 | 0.47 | 0.62 | | |
| alloy 303 | 1.78 | 0.48 | 0.62 | | |
| alloy 304 | 1.82 | 0.48 | 0.65 | | |
| alloy 305 | 1.74 | 0.49 | 0.65 | | |
| alloy 306 | 1.68 | 0.51 | 0.66 | | |
| alloy 307 | 1.73 | 0.49 | 0.65 | | |
| alloy 308 | 1.73 | 0.50 | 0.61 | | |
| alloy 309 | 1.74 | 0.49 | 0.61 | | |
| alloy 310 | 1.75 | 0.49 | 0.61 | | |

TABLE 1-continued

| | | | | | |
|---|---|---|---|---|---|
| alloy Y62 | 0.73 | 0.93 | 0.73 | 1280° C./4 h | 1080° C./4 h + 871° C./20 h |
| alloy Y62Y | 0.73 | 0.93 | 0.73 | | |
| alloy Y63 | 0.73 | 0.93 | 0.73 | — | |
| alloy MM | 1.59 | 0.55 | 0.84 | 1232° C./2 h | 982° C./5 h + 871° C./20 h |
| alloy 241 | 0.43 | 1.56 | 0.86 | 1200° C./4 h | 1080° C./4 h + 871° C./20 h |
| alloy 242 | 0.45 | 1.79 | 0.99 | | |
| alloy 245 | 0.47 | 1.99 | 1.23 | | |
| alloy 246 | 0.49 | 2.18 | 1.56 | | |
| alloy 247 | 0.51 | 2.37 | 1.97 | | |
| alloy 248 | 0.51 | 2.37 | 1.97 | | |
| alloy 251 | 0.37 | 1.82 | 0.95 | 1200° C./4 h | 1080° C./4 h + 871° C./20 h |
| alloy 252 | 0.39 | 2.08 | 1.09 | | |
| alloy 255 | 0.41 | 2.29 | 1.35 | | |
| alloy 256 | 0.43 | 2.52 | 1.68 | | |
| alloy 257 | 0.45 | 2.73 | 2.12 | | |
| alloy 258 | 0.40 | 2.30 | 1.35 | | |
| alloy 259 | 0.42 | 2.52 | 1.68 | | |
| alloy 260 | 0.44 | 2.75 | 2.12 | | |
| alloy 281 | 0.86 | 1.54 | 3.20 | 1200° C./2 h | 1080° C./4 h + 871° C./20 h |
| alloy 282 | 0.59 | 2.06 | 3.20 | | |
| alloy 283 | 0.40 | 2.85 | 3.20 | | |
| alloy 284 | 0.26 | 4.19 | 3.20 | | |
| alloy 285 | 0.45 | 2.46 | 2.64 | | |
| alloy 286 | 0.51 | 2.08 | 2.21 | | |
| alloy 287 | 0.60 | 1.69 | 1.88 | | |
| alloy 289 | 0.42 | 2.16 | 2.38 | | |
| alloy 290 | 0.52 | 2.07 | 2.21 | | |
| alloy 291 | 0.61 | 1.68 | 1.88 | | |
| alloy R | 0.85 | 1.58 | 3.33 | 1204° C./2 h | 1093° C./4 h + 1051° C./2 h + 843° C./16 h |
| alloy G | 0.38 | 3.15 | 3.31 | 1121° C./2 h | 843° C./2 h |

Parameter 1: (0.004 × W(wt %) + 0.004 × 2 × Mo(wt %) + 0.004 × Re(wt %))/(0.003 × 3.75 × Ti(wt %) + 0.006 × Ta(wt %) + 0.006 × 2 × Nb(wt %))
Parameter 2: (3.8 × Ti(wt %) + 2 × Nb(wt %) + Ta(wt %))/(2 × Mo(wt %) + W(wt %) + Re(wt %))
Parameter 3: (3.5 × Cr(wt %) + 3.8 × Ti(wt %))/(6.8 × Al(wt %))

TABLE 2

| | | | | Creep rupture time (h) | | Burner rig test result | Oxidation test result |
|---|---|---|---|---|---|---|---|
| alloy | Parameter 1 | Parameter 2 | Parameter 3 | 982° C.-14 kgf/mm$^2$ | 850° C.-40 kgf/mm$^2$ | Weight change (mg/cm$^2$) | Weight change (mg/cm$^2$) |
| alloy C1 | 1.89 | 0.41 | 0.61 | 1239 | — | 20.15 | −0.5 |
| alloy C2 | 1.92 | 0.41 | 0.57 | 1176 | — | 11.29 | −0.5 |
| alloy C3 | 1.95 | 0.45 | 0.64 | 1240 | — | 19.85 | −0.9 |
| alloy C4 | 1.88 | 0.46 | 0.60 | 1153 | — | 10.50 | −0.8 |
| alloy 187 | 1.75 | 0.49 | 0.61 | 1224 | — | 25.47 | −0.7 |
| alloy 188 | 1.74 | 0.49 | 0.61 | 1186 | — | 21.17 | −0.8 |
| alloy 189 | 1.66 | 0.51 | 0.62 | 1091 | — | 13.06 | −0.9 |
| alloy 190 | 1.67 | 0.44 | 0.56 | 1154 | — | 28.20 | −0.3 |
| alloy 191 | 1.65 | 0.44 | 0.57 | 1072 | — | 28.04 | −0.4 |
| alloy 192 | 1.57 | 0.46 | 0.56 | 1070 | — | 15.61 | −0.3 |
| alloy 193 | 1.66 | 0.44 | 0.56 | 1236 | — | 23.18 | −0.4 |
| alloy 194 | 1.65 | 0.44 | 0.56 | 1177 | — | 23.61 | −0.4 |
| alloy 195 | 1.58 | 0.46 | 0.56 | 1176 | — | 14.71 | −0.3 |
| alloy 196 | 2.18 | 0.40 | 0.64 | 1004 | — | 35.09 | −1.2 |
| alloy 197 | 2.08 | 0.42 | 0.66 | 875 | — | 32.30 | −1.3 |
| alloy 200 | 1.30 | 0.62 | 0.62 | 1024 | — | — | — |
| alloy 201 | 1.17 | 0.76 | 0.69 | 858 | — | — | — |
| alloy 298 | 1.83 | 0.47 | 0.61 | — | — | — | — |
| alloy 299 | 1.79 | 0.48 | 0.61 | — | — | — | — |
| alloy 300 | 1.79 | 0.48 | 0.61 | — | — | — | — |
| alloy 301 | 1.82 | 0.47 | 0.61 | — | — | — | — |
| alloy 302 | 1.83 | 0.47 | 0.62 | — | — | — | — |
| alloy 303 | 1.78 | 0.48 | 0.62 | — | — | — | — |
| alloy 304 | 1.82 | 0.48 | 0.65 | — | — | — | — |
| alloy 305 | 1.74 | 0.49 | 0.65 | — | — | — | — |
| alloy 306 | 1.68 | 0.51 | 0.66 | — | — | — | — |
| alloy 307 | 1.73 | 0.49 | 0.65 | — | — | — | — |
| alloy 308 | 1.73 | 0.50 | 0.61 | — | — | — | — |
| alloy 309 | 1.74 | 0.49 | 0.61 | — | — | — | — |
| alloy 310 | 1.75 | 0.49 | 0.61 | — | — | — | — |
| alloy Y62 | 0.73 | 0.93 | 0.73 | 4220 | — | 0.20 | −4.7 |
| alloy Y63 | 0.73 | 0.93 | 0.73 | 590 | — | — | — |
| alloy MM | 1.59 | 0.55 | 0.84 | 725 | 965 | 35.67 | −18.0 |

TABLE 2-continued

| alloy | Parameter 1 | Parameter 2 | Parameter 3 | Creep rupture time (h) 982° C.-14 kgf/mm$^2$ | Creep rupture time (h) 850° C.-40 kgf/mm$^2$ | Burner rig test result Weight change (mg/cm$^2$) | Oxidation test result Weight change (mg/cm$^2$) |
|---|---|---|---|---|---|---|---|
| alloy 241 | 0.43 | 1.56 | 0.86 | — | 793 | 37.80 | — |
| alloy 242 | 0.45 | 1.79 | 0.99 | — | 731 | 35.20 | — |
| alloy 245 | 0.47 | 1.99 | 1.23 | — | 688 | 20.22 | — |
| alloy 246 | 0.49 | 2.18 | 1.56 | — | 654 | 10.30 | — |
| alloy 247 | 0.51 | 2.37 | 1.97 | — | 633 | 0.33 | — |
| alloy 248 | 0.51 | 2.37 | 1.97 | — | 615 | 0.21 | — |
| alloy 251 | 0.37 | 1.82 | 0.95 | — | 677 | 33.80 | — |
| alloy 252 | 0.39 | 2.08 | 1.09 | — | 675 | 28.50 | — |
| alloy 255 | 0.41 | 2.29 | 1.35 | — | 653 | 16.60 | — |
| alloy 256 | 0.43 | 2.52 | 1.68 | — | 648 | 10.50 | — |
| alloy 257 | 0.45 | 2.73 | 2.12 | — | 620 | 0.35 | — |
| alloy 258 | 0.40 | 2.30 | 1.35 | — | 637 | 10.30 | — |
| alloy 259 | 0.42 | 2.52 | 1.68 | — | 645 | 11.30 | — |
| alloy 260 | 0.44 | 2.75 | 2.12 | — | 625 | 0.33 | — |
| alloy 281 | 0.86 | 1.54 | 3.20 | — | 680 | 18.30 | −200.5 |
| alloy 282 | 0.59 | 2.06 | 3.20 | — | 550 | 15.30 | −120.8 |
| alloy 283 | 0.40 | 2.85 | 3.20 | — | 280 | 0.55 | −78.8 |
| alloy 284 | 0.26 | 4.19 | 3.20 | — | 3 | 0.31 | −38.7 |
| alloy 285 | 0.45 | 2.46 | 2.64 | — | 320 | 0.32 | −30.8 |
| alloy 286 | 0.51 | 2.08 | 2.21 | — | 404 | 0.16 | −25.7 |
| alloy 287 | 0.60 | 1.69 | 1.88 | — | 409 | 0.21 | −23.8 |
| alloy 289 | 0.42 | 2.16 | 2.38 | — | 538 | 0.25 | −25.5 |
| alloy 290 | 0.52 | 2.07 | 2.21 | — | 541 | 0.18 | −30.5 |
| alloy 291 | 0.61 | 1.68 | 1.88 | — | 546 | 0.19 | −24.8 |
| alloy R | 0.85 | 1.58 | 3.33 | — | 292 | 14.04 | −137.8 |
| alloy G | 0.38 | 3.15 | 3.31 | — | 92 | 0.15 | −53.3 |

Parameter 1: (0.004 × W(wt %) + 0.004 × 2 × Mo(wt %) + 0.004 × Re(wt %))/(0.003 × 3.75 × Ti(wt %) + 0.006 × Ta (wt %) + 0.006 × 2 × Nb(wt %))
Parameter 2: (3.8 × Ti(wt %) + 2 × Nb(wt %) + Ta(wt %))/(2 × Mo(wt %) + W(wt %) + Re(wt %))
Parameter 3: (3.5 × Cr(wt %) + 3.8 × Ti(wt %))/(6.8 × Al(wt %))

Figure 2:
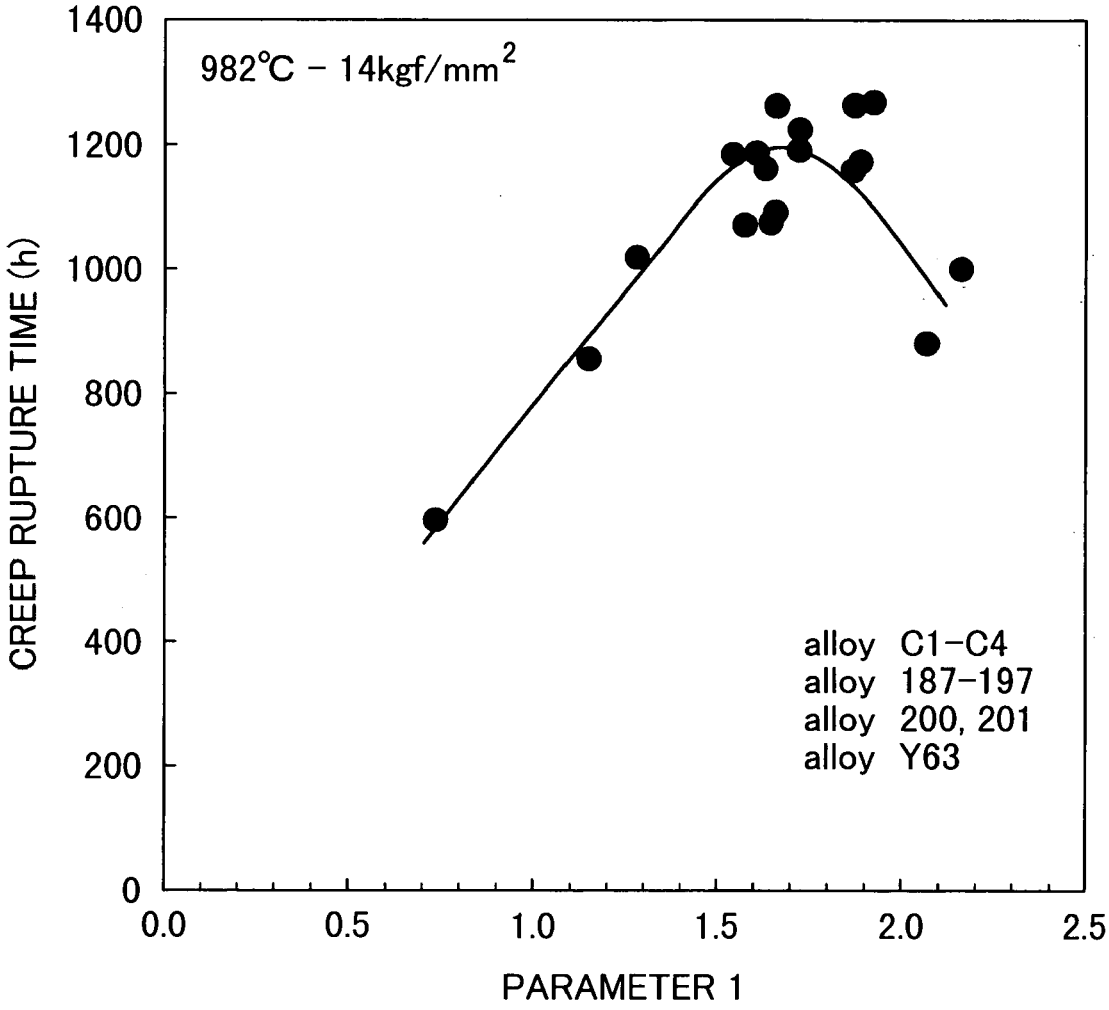
FIG. 2 is a characteristic graph showing the relationship between the parameter 1 and the creep rupture time.

FIG. 1 shows the result of creep rupture tests made on the alloy group evaluated without being subjected to the solution heat treatment. In the creep rupture test, the specimen was sampled in a direction parallel to the solidifying direction, i.e., a direction parallel to the grain boundary. FIG. 2 shows the relationship between the parameter 1 and the creep rupture time. As seen from the results shown in FIGS. 1 and 2, the alloys with the parameter 1 being in the range of 1.0 to 2.5 exhibit superior creep rupture strength even when not subjected to the solution heat treatment, while the alloys with the parameter 1 being outside the above-mentioned range exhibit superior creep rupture strength when subjected to the solution heat treatment as well, but their creep rupture strength is significantly reduced when subjected to the aging heat treatment only.

Figure 3:
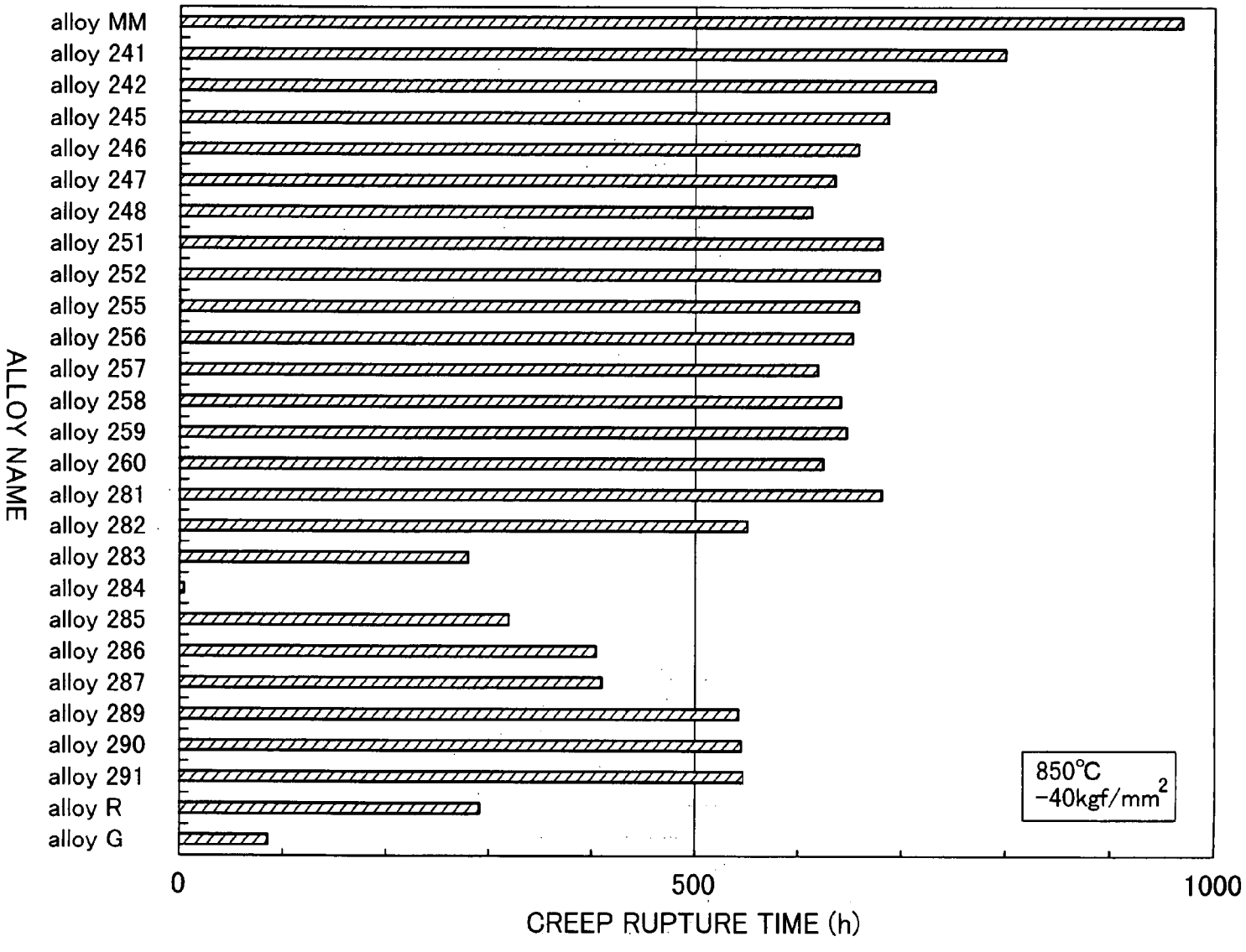
FIG. 3 is a graph showing the result of creep rupture tests made on an alloy group subjected to the solution heat treatment.
Figure 4:
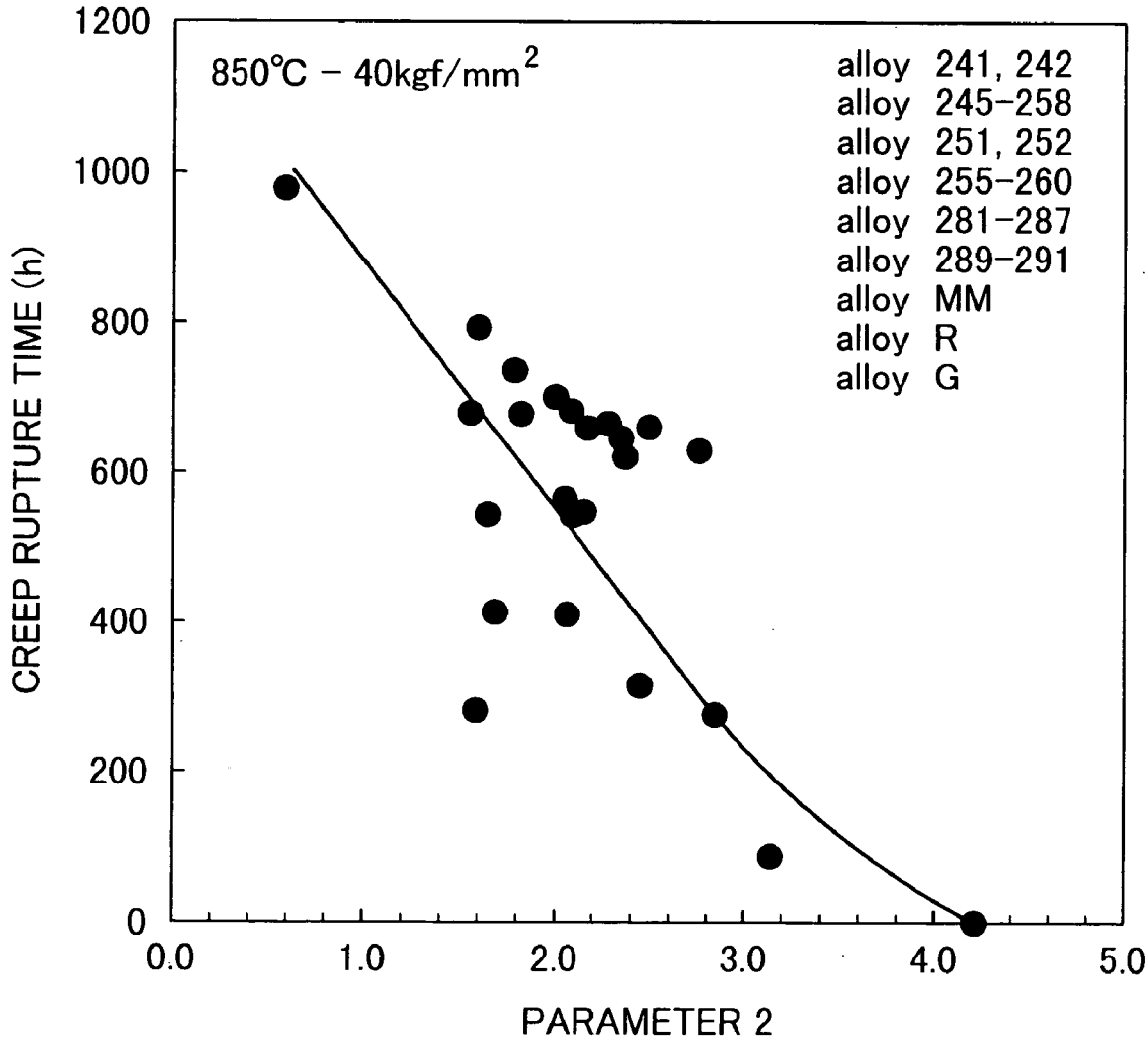
FIG. 4 is a characteristic graph showing the relationship between the parameter 2 and the creep rupture time.

FIG. 3 shows the result of creep rupture tests made on the alloy group subjected to the solution heat treatment. Also in this test, the specimen was sampled in a direction parallel to the solidifying direction, i.e., a direction parallel to the grain boundary. FIG. 4 shows the relationship between the parameter 2 and the creep rupture time. As seen from FIG. 4, the creep rupture time is shortened as the parameter 2 increases. The reason is that, when the parameter 2 exceeds above 2.8, stability of the γ' phase is lost and precipitation of the η phase is started.

Figure 5:
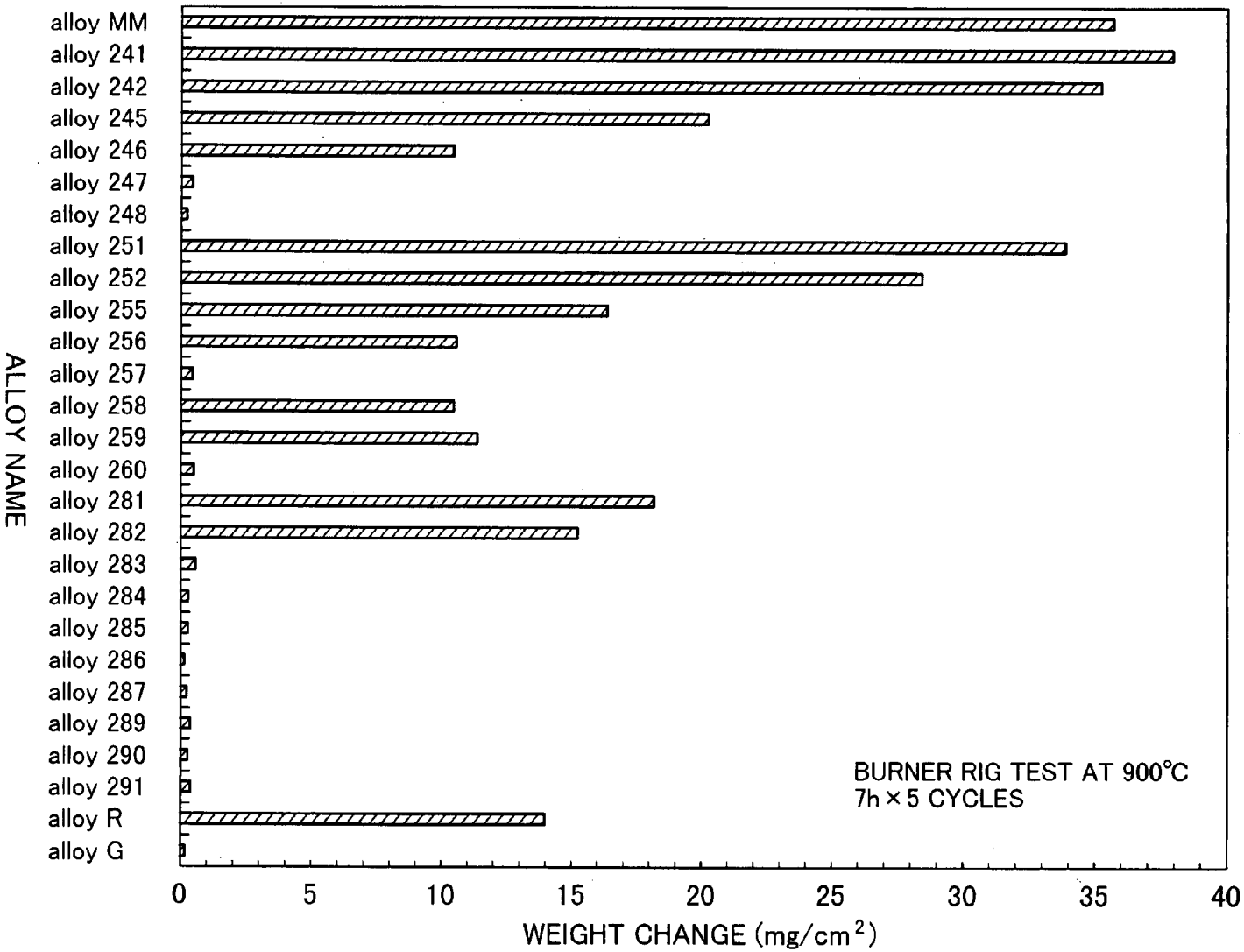
FIG. 5 is a graph showing the result of hot corrosion resistance evaluation, based on burner rig tests, of the alloy group subjected to the solution heat treatment.
Figure 6:
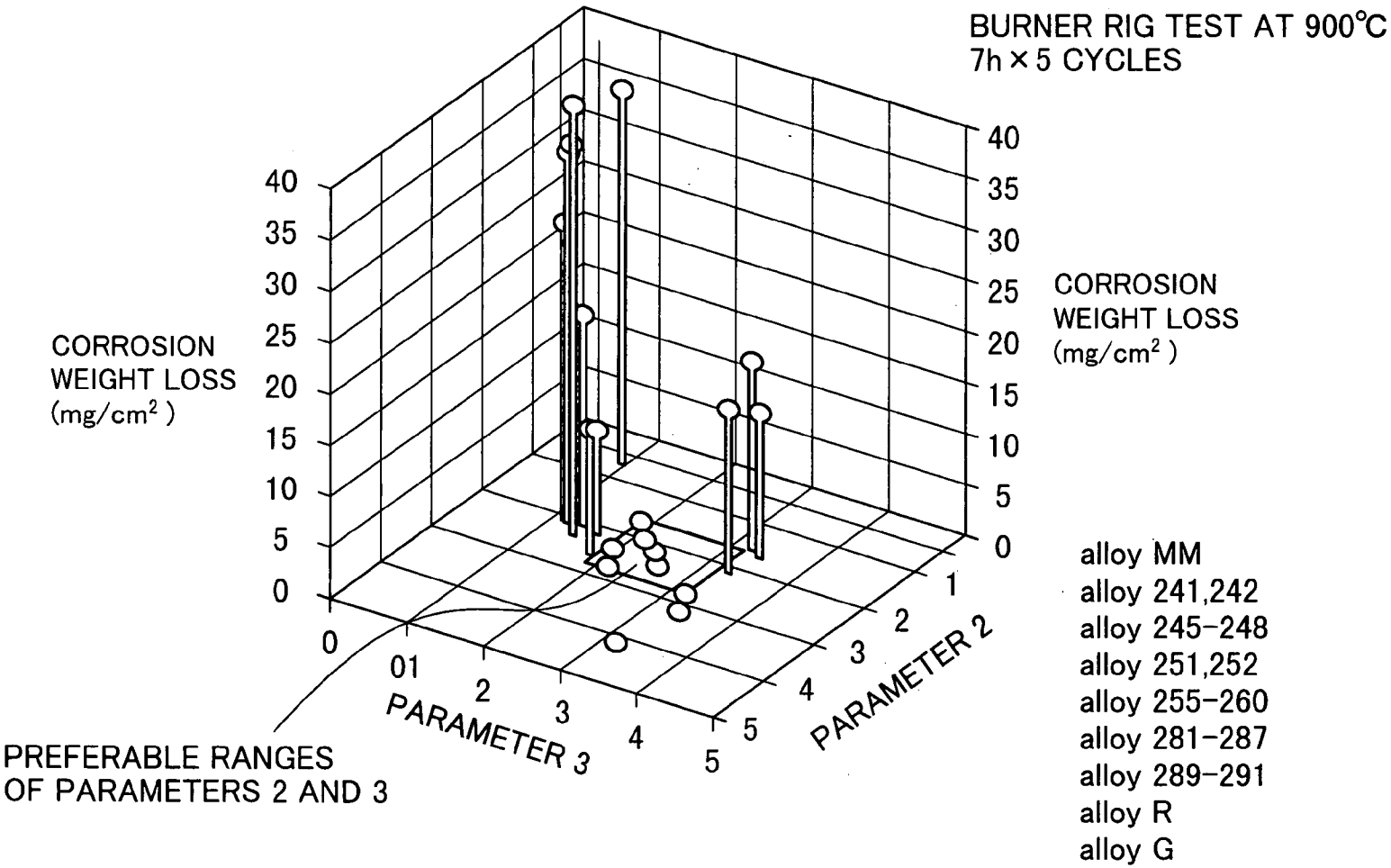
FIG. 6 is a graph showing the result of hot corrosion resistance evaluation, based on burner rig tests, of the alloy group subjected to the solution heat treatment, the results being rearranged with respect to the parameter 2 and the parameter 3.

FIG. 5 shows the result of hot corrosion resistance evaluation, based on burner rig tests at 900° C. (7 hours×5 cycles), of the alloy group subjected to the solution heat treatment. FIG. 6 shows the hot corrosion resistance evaluation results after being rearranged with respect to the parameter 2 and the parameter 3. From the standpoint of creep rupture strength, the parameter 2 is preferably set as small as possible. From the standpoint of hot corrosion resistance, however, the parameter 2 is preferably set as large as possible as seen from the results of FIG. 6. To obtain not only excellent hot corrosion resistance, but also satisfactory creep rupture strength, therefore, it is desired that the parameter 2 be in the range of 1.6 to 2.8 and the parameter 3 be in the range of 1.8 to 3.2.

Figure 7:
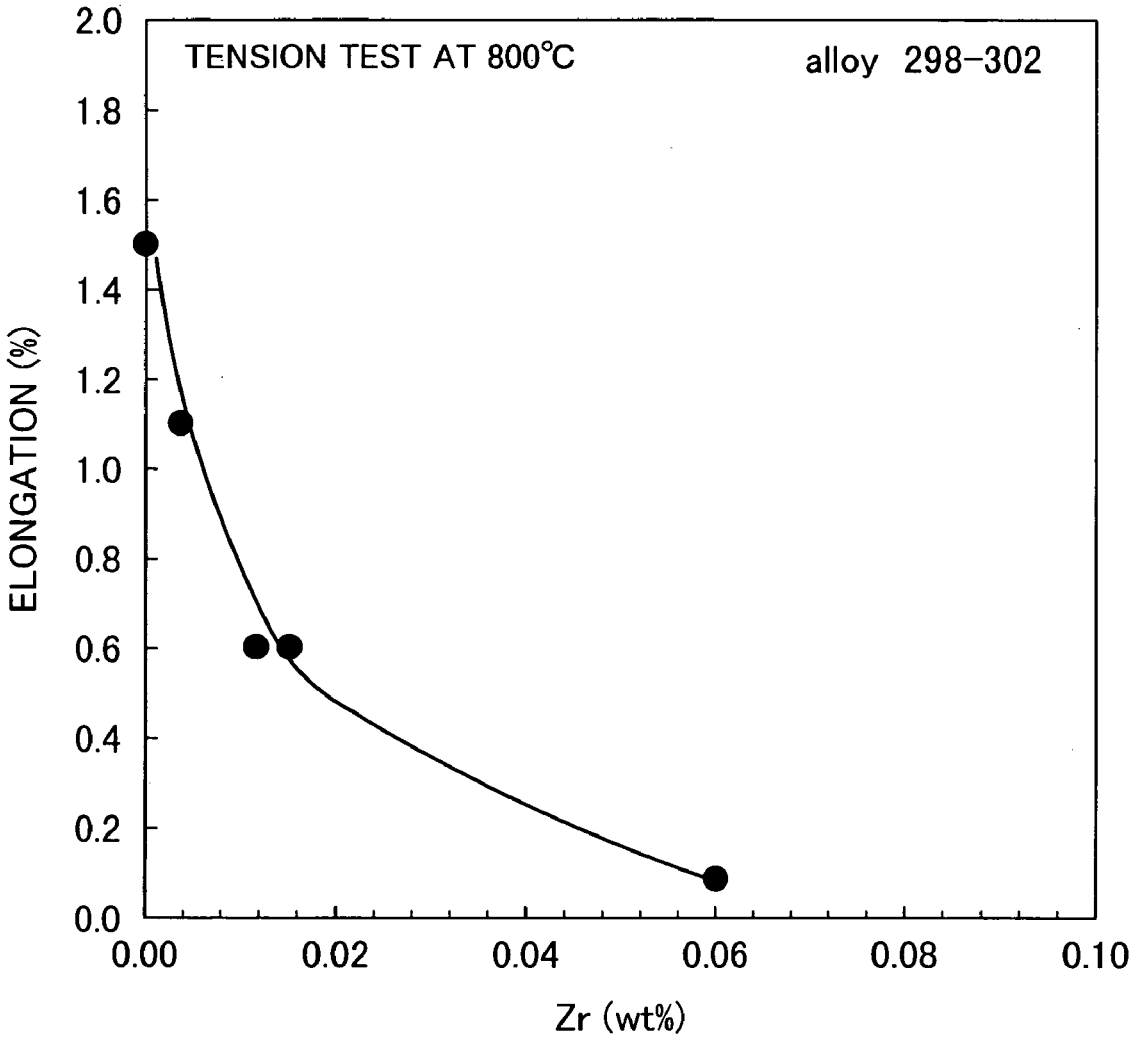
FIG. 7 is a characteristic graph showing an effect of the Zr content upon ductility of the grain boundary.

FIG. 7 shows the result of studying an effect of Zr upon ductility of the grain boundary. Each specimen was sampled from the unidirectionally solidified slab mentioned above, and it was subjected to the solution heat treatment of 1250° C./4 h/AC and then two steps of the aging heat treatment, i.e., 1080° C./4 h/AC+871° C./20 h/AC. The specimen was sampled in a direction perpendicular to the solidifying direction, i.e., a direction perpendicular to the grain boundary. After the heat treatments, the specimen was subjected to a tension test at 800° C., and the effect of Zr upon ductility of the grain boundary was studied based on the elongation resulting from the tension test. As seen from FIG. 7, maximum ductility is obtained when Zr is not added.

Figure 8:
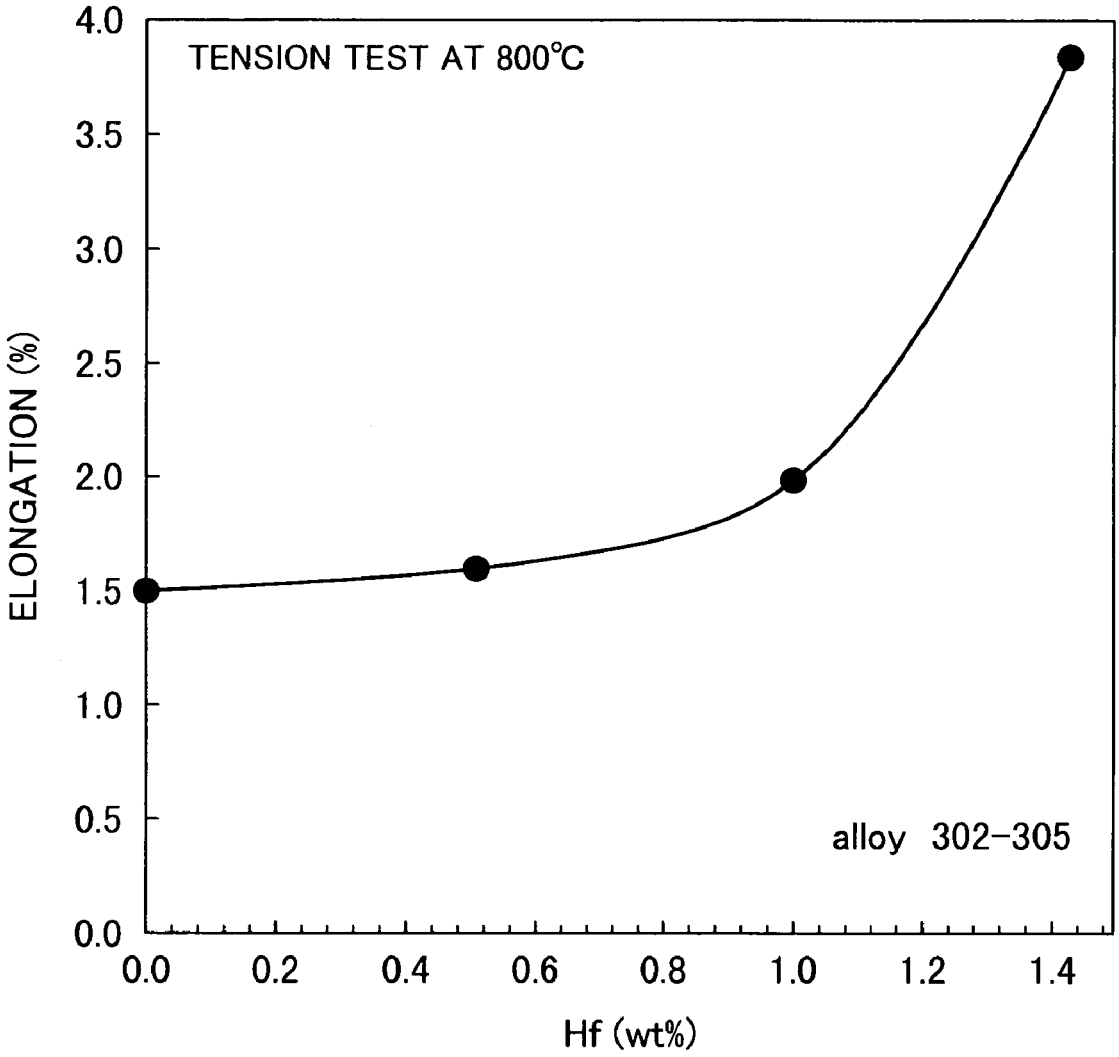
FIG. 8 is a characteristic graph showing an effect of the Hf content upon ductility of the grain boundary.

FIG. 8 shows the result of studying an effect of Hf upon ductility of the grain boundary. As in the above case of studying the effect of Zr, each specimen was sampled from the unidirectionally solidified slab mentioned above, and it was subjected to the solution heat treatment of 1250° C./4 h/AC and then two steps of the aging heat treatment, i.e., 1080° C./4 h/AC+871° C./20 h/AC. The specimen was sampled in the direction perpendicular to the solidifying direction. After the heat treatments, the specimen was subjected to a tension test at 800° C., and the effect of Hf upon ductility of the grain boundary was studied based on the elongation resulting from the tension test. As seen from FIG. 8, unlike Zr, Hf is remarkably effective in improving the ductility of the crystal grain boundary.

Figure 9:
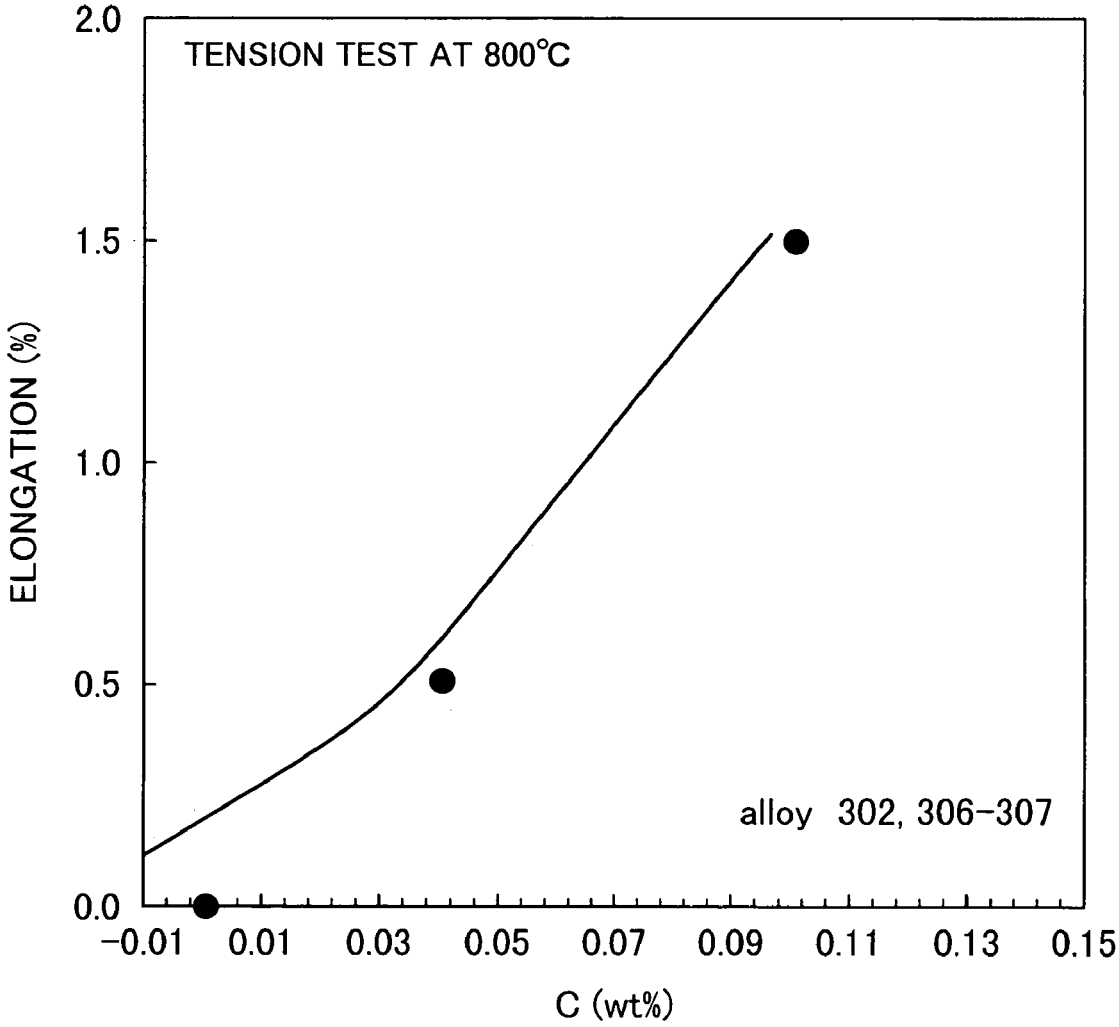
FIG. 9 is a characteristic graph showing an effect of the C content upon ductility of the grain boundary.

FIG. 9 shows the result of studying an effect of C upon ductility of the grain boundary. Each specimen was sampled from the unidirectionally solidified slab mentioned above, and it was subjected to the solution heat treatment of 1250° C./4 h/AC and then two steps of the aging heat treatment, i.e., 1080° C./4 h/AC+871° C./20 h/AC. The specimen was sampled in the direction perpendicular to the solidifying direction. After the heat treatments, the specimen was subjected to a tension test at 800° C., and the effect of C upon ductility of the grain boundary was studied based on the elongation resulting from the tension test. As seen from the result of FIG. 9, C is remarkably effective in improving the ductility of the grain boundary.

Figure 10:
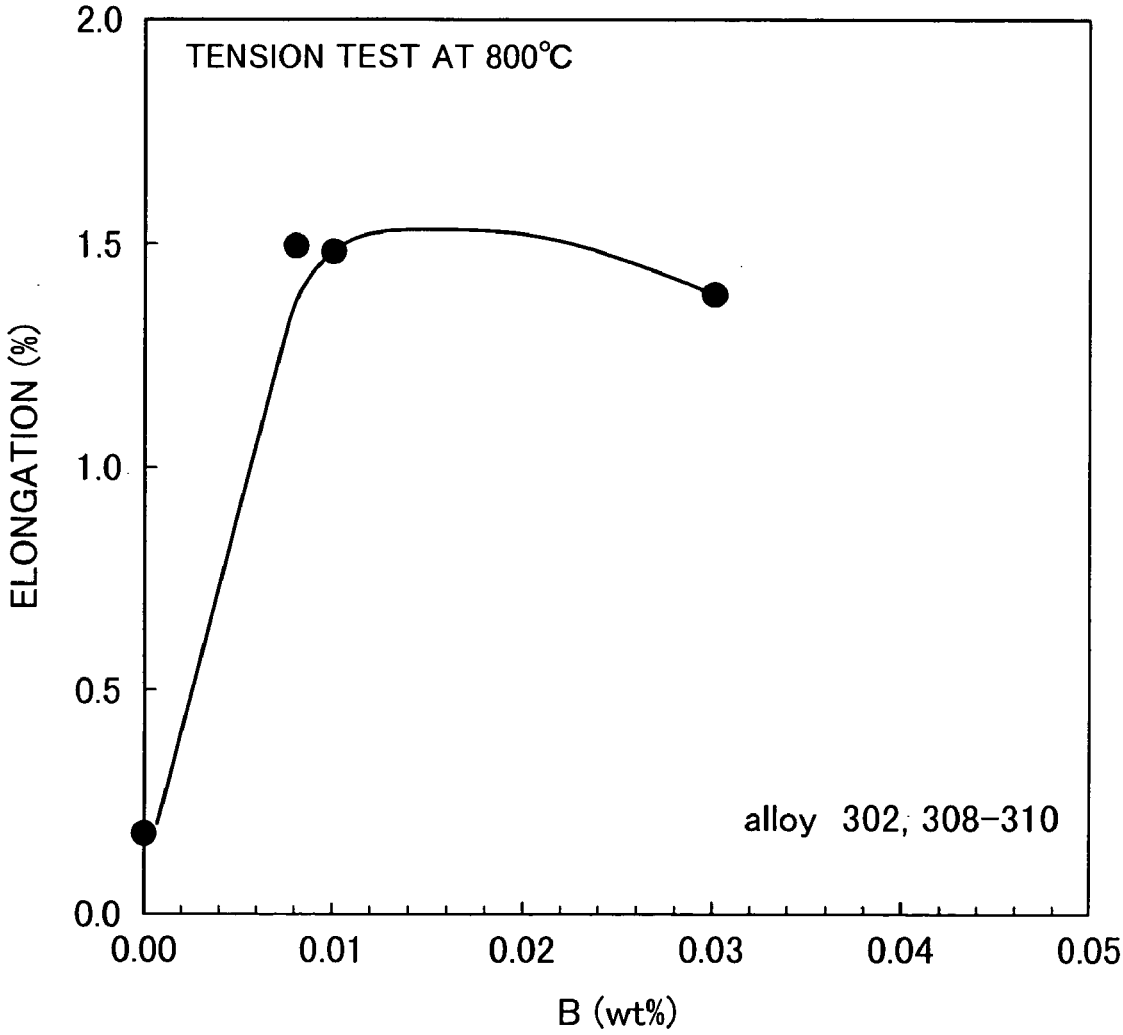
FIG. 10 is a characteristic graph showing an effect of the B content upon ductility of the grain boundary.

FIG. 10 shows the result of studying an effect of B upon ductility of the grain boundary. Each specimen was sampled from the unidirectionally solidified slab mentioned above, and it was subjected to the solution heat treatment of 1250° C./4 h/AC and then two steps of the aging heat treatment, i.e., 1080° C./4 h/AC+871° C./20 h/AC. The specimen was sampled in the direction perpendicular to the solidifying direction. After the heat treatments, the specimen was subjected to a tension test at 800° C., and the effect of B upon ductility of the grain boundary was studied based on the elongation resulting from the tension test. As seen from the result of FIG. 10, B is remarkably effective in improving the ductility of the crystal grain boundary.

Figure 11:
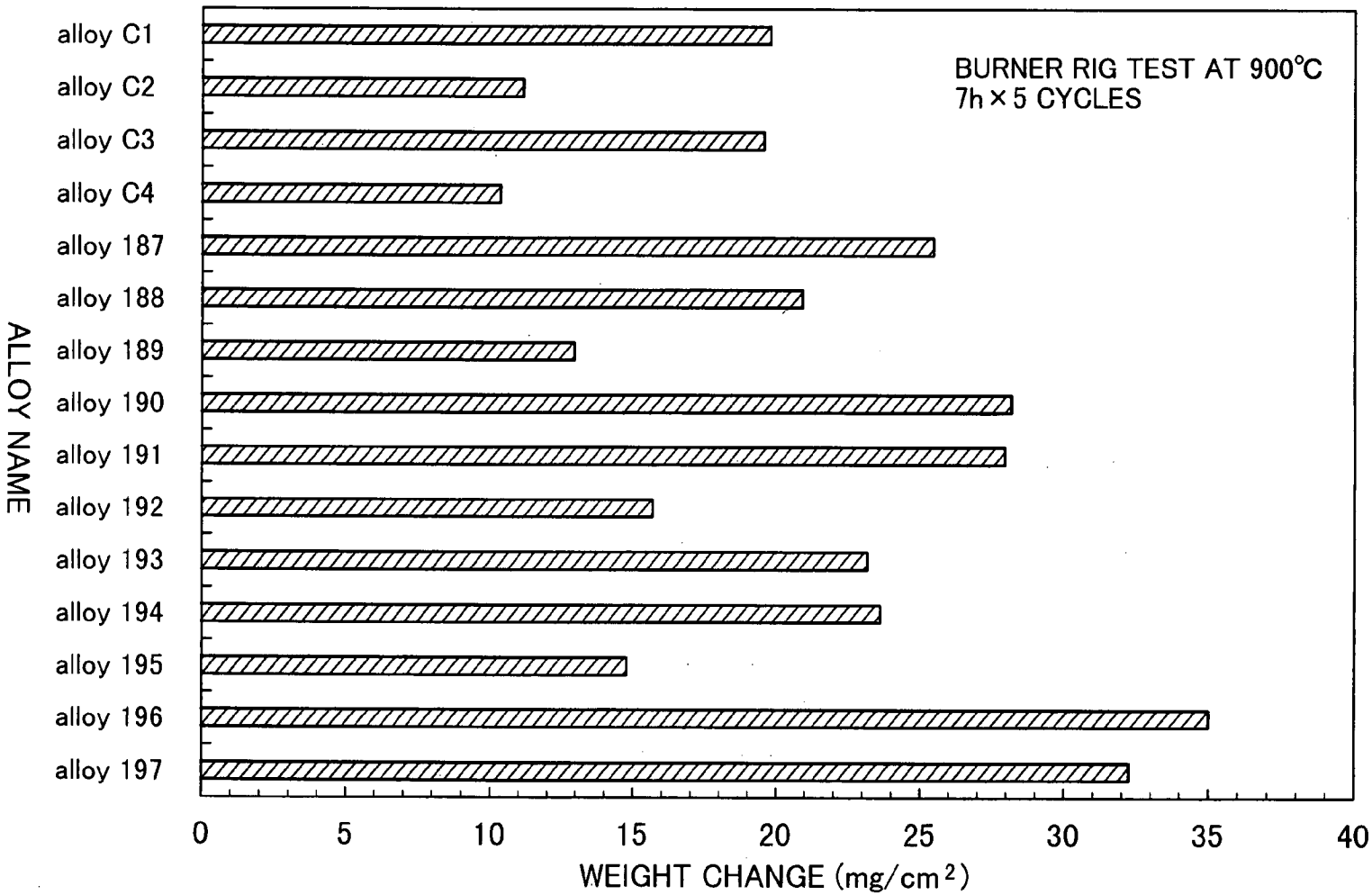
FIG. 11 is a graph showing the result of hot corrosion resistance evaluation, based on burner rig tests, of the alloy group not subjected to the solution heat treatment.
Figure 12:
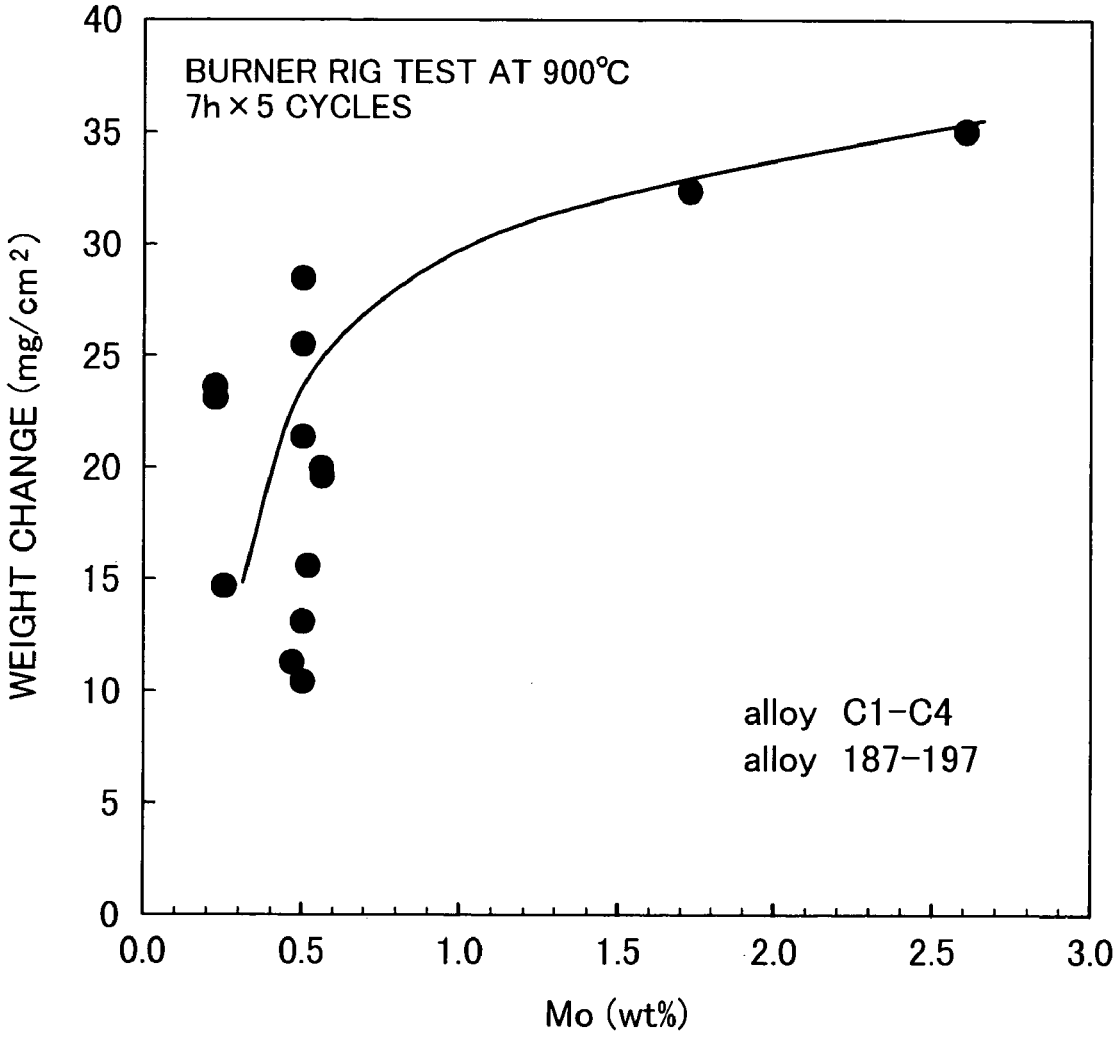
FIG. 12 is a characteristic graph showing the relationship between the Mo content and the amount of weight change after the burner rig test.

FIG. 11 shows the result of hot corrosion resistance evaluation, based on burner rig tests, of the alloy group not subjected to the solution heat treatment. FIG. 12 shows the relationship between the Mo content and the amount of weight change after the burner rig test. As seen from the results of FIGS. 11 and 12, hot corrosion resistance is improved with a reduction of the Mo content.

Figure 13:
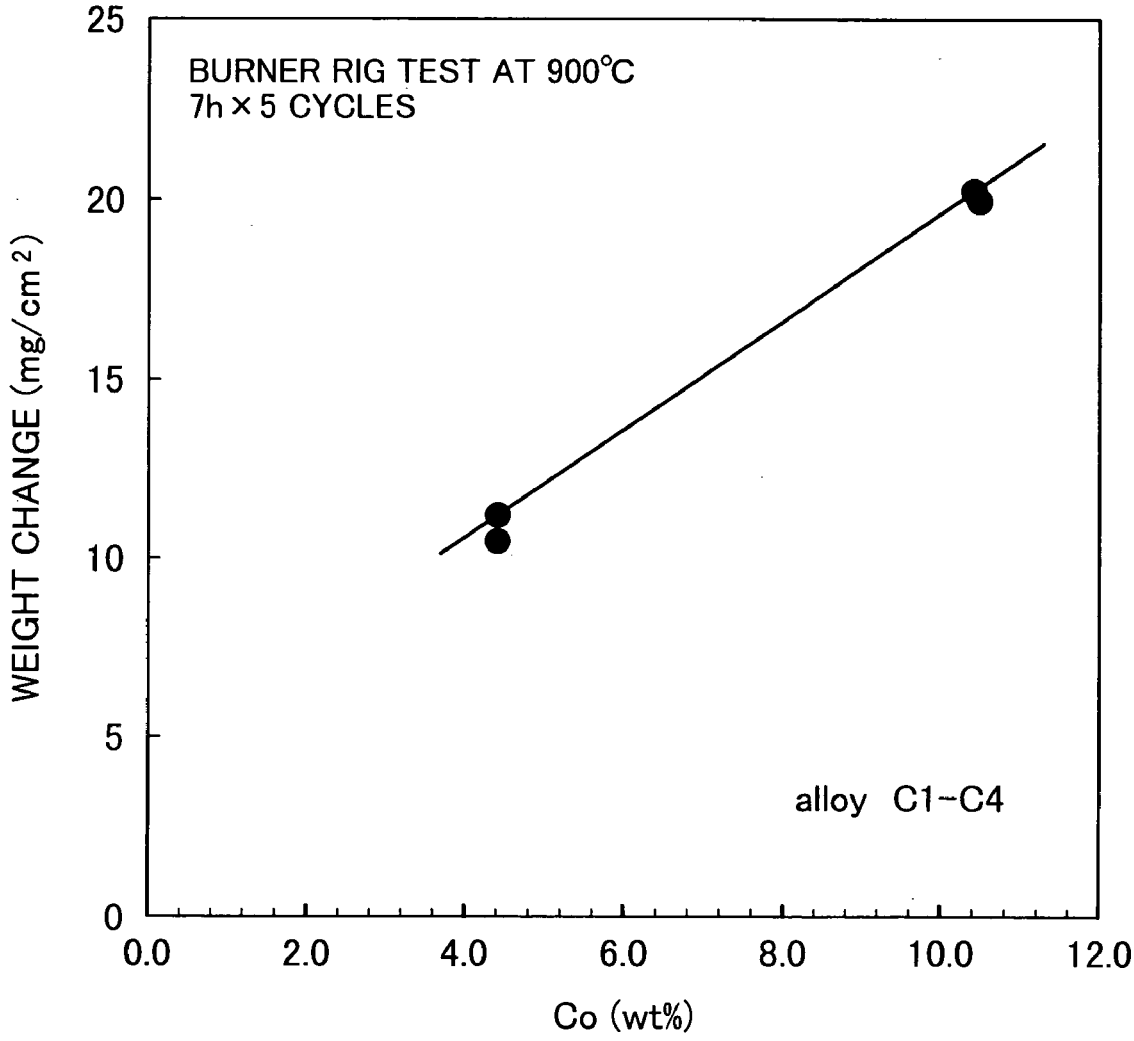
FIG. 13 is a characteristic graph showing the relationship between the Co content and the amount of weight change after the burner rig test.

Further, FIG. 13 shows the relationship between the Co content and the amount of weight change after the burner rig test. As seen from the result of FIG. 13, hot corrosion resistance is improved with a reduction of the Co content.

Figure 14:
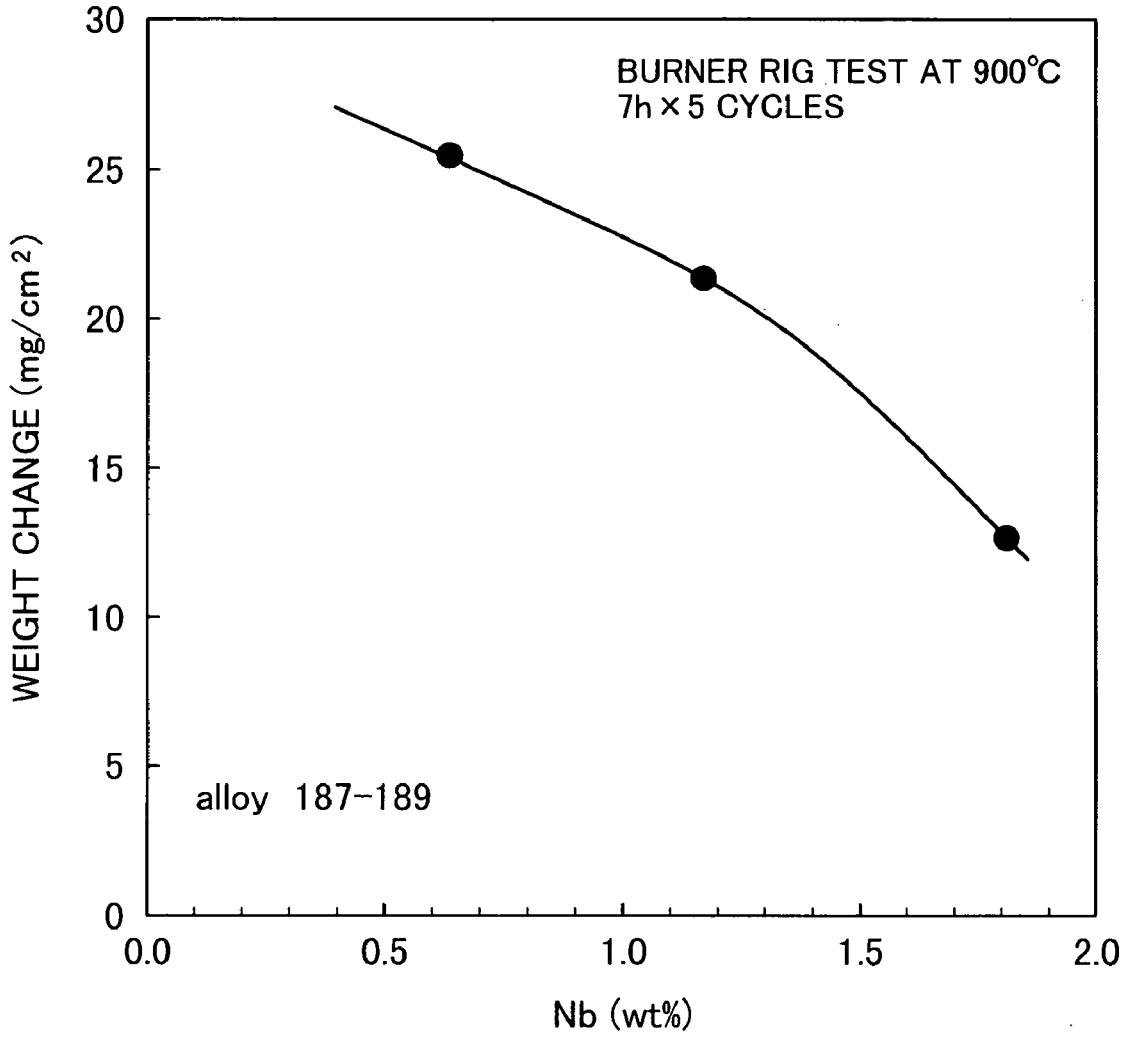
FIG. 14 is a characteristic graph showing the relationship between the Nb content and the amount of weight change after the burner rig test.

FIG. 14 shows the relationship between the Nb content and the amount of weight change after the burner rig test. As seen from the result of FIG. 14, Nb is effective in improving hot corrosion resistance.

Figure 15:
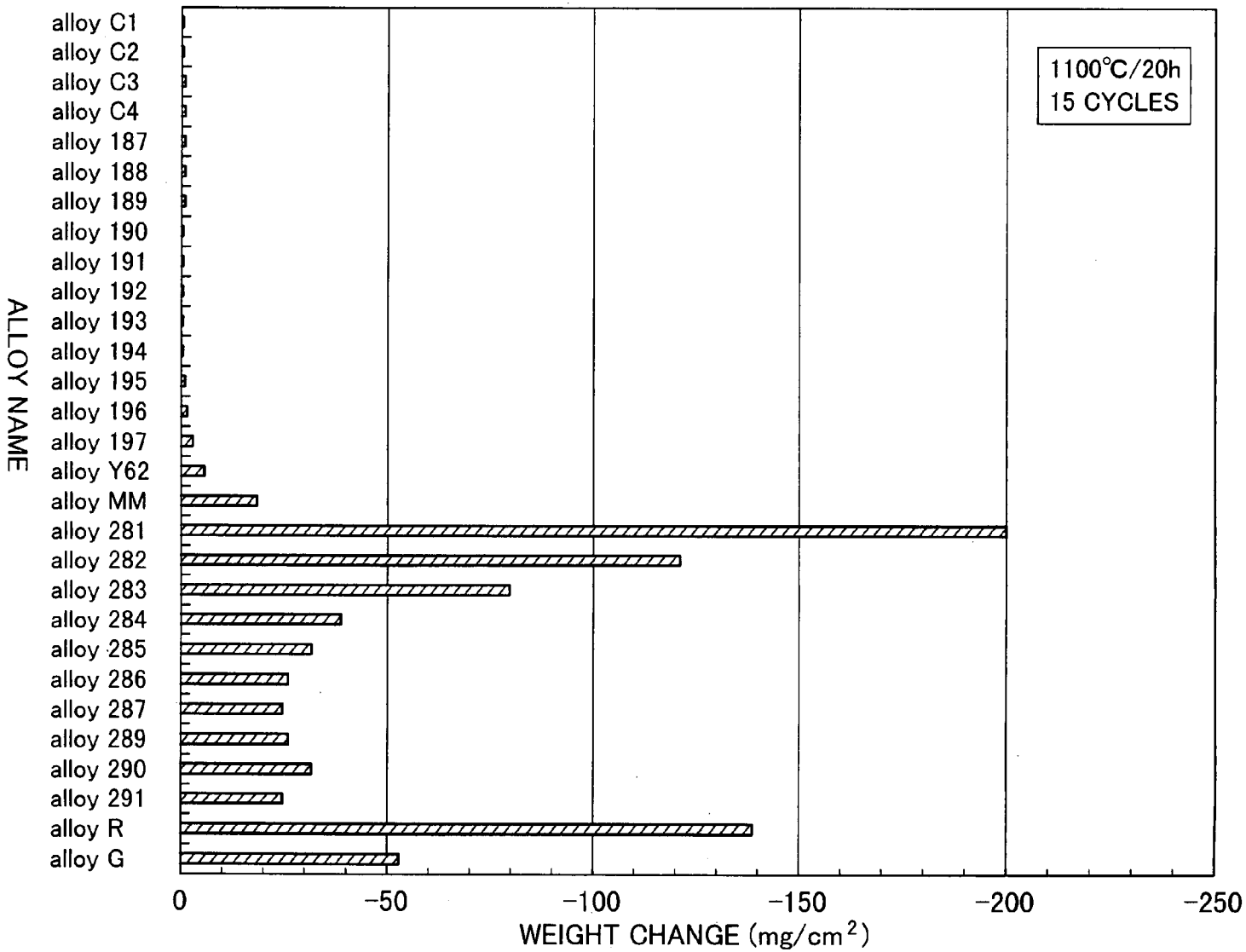
FIG. 15 is a graph showing the result of oxidation resistance tests.
Figure 16:
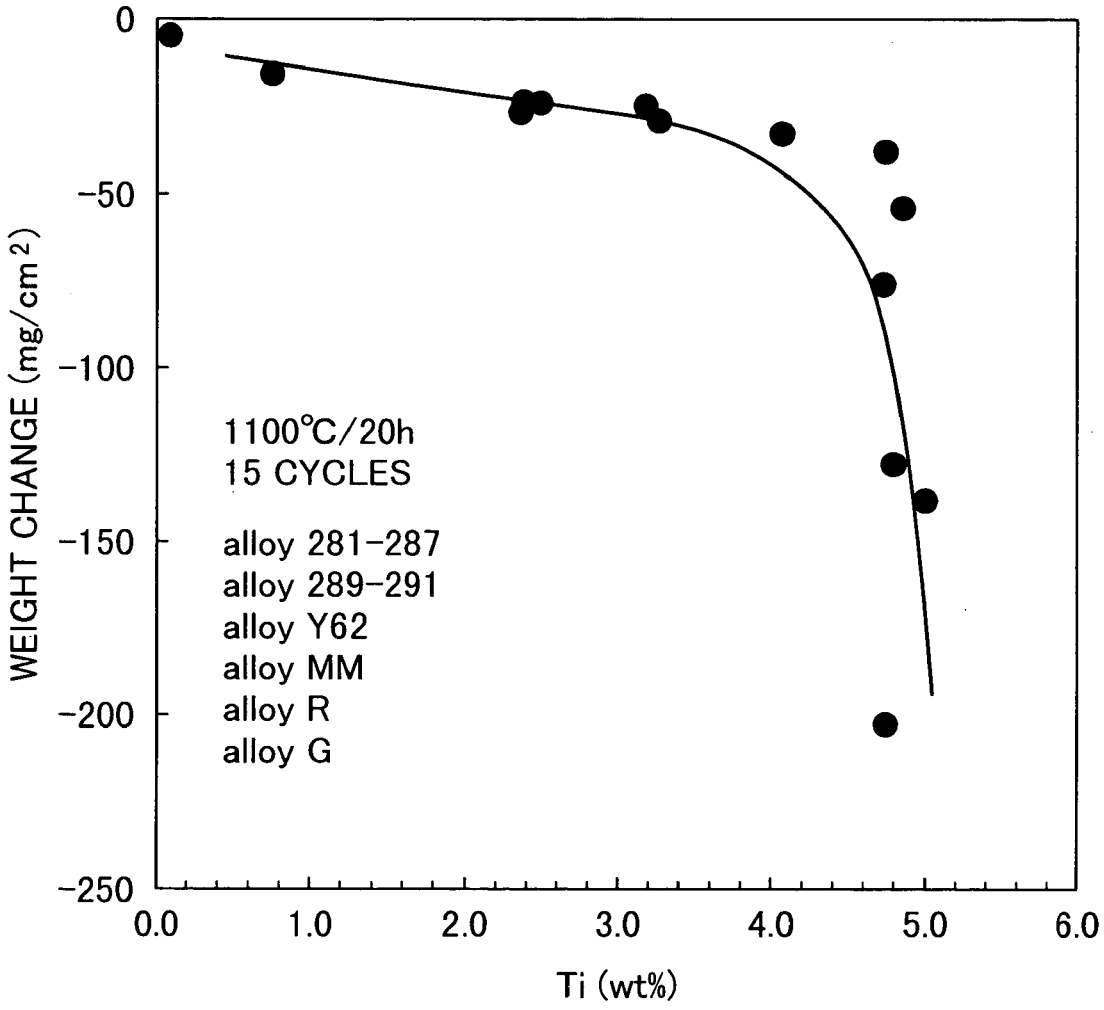
FIG. 16 is a characteristic graph showing the relationship between the Ti content and the amount of weight change after the oxidation resistance tests for the alloy group subjected to the solution heat treatment.

FIG. 15 shows the result of oxidation resistance tests, and FIG. 16 shows the relationship between the Ti content and the amount of weight change after the oxidation resistance test for the alloy group subjected to the solution heat treatment. As seen from the results of FIGS. 15 and 16, oxidation resistance is improved with a reduction of the Ti content.

Thus, the present invention can provide a Ni-based superalloy which is able to exhibit not only superior strength at high temperatures, but also excellent hot corrosion resistance and oxidation resistance at high temperatures in spite of containing no Re or reducing the amount of Re.

What is claimed is:

1. A Ni-based superalloy having high oxidation resistance, the superalloy being hardened by dispersing γ' phases in a γ-phase matrix, wherein the superalloy contains, by weight, C: 0.05 to 0.2%, B: 0.01 to 0.03%, Hf: 1.1 to 2.5%, Co: 9.7 to 15%, Ta: 0.1 to 4.5%, Cr: 1.5 to 9%, Mo: 0.01 to 0.9%, W: 5 to 14%, Ti: 0.1 to 4.75%, Al: 4 to 7%, Nb: 0.1 to less than 4%, Re: 0.01 to less than 9%, at least one of rare earth elements: 0 to less than 0.1% in total, and any of V, Zr and platinum group elements: not more than 0.005%.

2. A Ni-based superalloy according to claim 1, wherein Ti is in the range of 0.1 to 0.45 percent by weight.

3. A Ni-based superalloy having high oxidation resistance, the superalloy being hardened by dispersing γ' phases in a γ-phase matrix, wherein the superalloy contains, by weight, C: 0.01 to 0.5%, B: 0.01 to 0.03%, Hf: 1.1 to 2.5%, Co: 9.7 to 15%, Ta: less than 8.5%, Cr: 1.5 to 16%, Mo: less than 1.0%, W: 5 to 14%, Ti: 0.1 to 4.75%, Al: 4 to 7%, Nb: less than 4%, Re: 0.01 to less than 9%, at least one of platinum group elements: 0 to less than 0.5% in total, at least one of rare earth elements: 0 to less than 0.1% in total, and any of V and Zr: not more than 0.005%, and wherein a value obtained from a formula of (0.004×W content (weight %)+0.004×2×Mo content (weight %)+0.004×Re content (weight %))/(0.003×3×Ti content (weight %)+0.006×Ta content (weight %)+0.006×2×Nb content (weight %)) is in the range of 1.0 to 2.5.

4. A Ni-based superalloy according to claim 3, wherein the value obtained from the formula of (0.004×W content (weight %)+0.004×2×Mo content (weight %)+0.004×Re content (weight %))/(0.003×3×Ti content (weight %)+0.006×Ta content (weight %)+0.006×2×Nb content (weight %)) is in the range of 1.5 to 2.0.

5. A Ni-based superalloy casting having high oxidation resistance, wherein the superalloy according to claim 1 is cast by a unidirectional solidifying process.

6. A Ni-based superalloy casting having high oxidation resistance, wherein the superalloy according to claim 3 is cast by a unidirectional solidifying process.

7. A gas turbine part made from the superalloy according to claim 1.

8. A gas turbine part made from the superalloy according to claim 3.

* * * * *